US010363648B2

(12) United States Patent
Bryntesen et al.

(10) Patent No.: US 10,363,648 B2
(45) Date of Patent: Jul. 30, 2019

(54) APPARATUS, COMPONENTS, METHODS AND SYSTEMS FOR USE IN SELECTIVELY TEXTURING CONCRETE SURFACES

(71) Applicant: C.J. Spray, Eagan, MN (US)

(72) Inventors: Chris Bryntesen, Eagan, MN (US); Levi Leppke, Chanhassen, MN (US)

(73) Assignee: C.J. Spray, Eagan, MN (US)

( * ) Notice: Subject to any disclaimer, the term of this patent is extended or adjusted under 35 U.S.C. 154(b) by 0 days.

(21) Appl. No.: 15/665,527

(22) Filed: Aug. 1, 2017

(65) Prior Publication Data

US 2018/0036865 A1 Feb. 8, 2018

Related U.S. Application Data

(60) Provisional application No. 62/371,096, filed on Aug. 4, 2016.

(51) Int. Cl.
*B24C 3/06* (2006.01)
*B24C 5/04* (2006.01)
(Continued)

(52) U.S. Cl.
CPC ..... *B24C 3/062* (2013.01); *B24C 1/04* (2013.01); *B24C 1/06* (2013.01); *B24C 3/32* (2013.01);
(Continued)

(58) Field of Classification Search
CPC .. B24C 3/062; B24C 3/32; B24C 1/04; B24C 5/04; B24C 7/0023; B24C 7/0038;
(Continued)

(56) References Cited

U.S. PATENT DOCUMENTS 1,882,541 A 10/1932 Billman
2,387,193 A * 10/1945 Swenarton ..... B24C 1/086 134/36
(Continued)

FOREIGN PATENT DOCUMENTS

DE 39 27 601 A1 3/1991
EP 0 645 214 A1 3/1995
EP 2 952 310 A1 9/2015

OTHER PUBLICATIONS

EcoQuip Vapor Abrasive Blast Equipment, Graco Inc., 7 pages (Revised Dec. 2014).
(Continued)

*Primary Examiner* — George B Nguyen
(74) *Attorney, Agent, or Firm* — Merchant & Gould P.C.

(57) ABSTRACT

Apparatuses, components, methods, and techniques for selectively texturing concrete surfaces are provided. An example method of providing a surface portion of an architectural precast concrete wall panel with an abraded texture is provided. The method includes a step of spraying a surface portion of an architectural precast concrete wall panel with an aqueous-based particulate abrasive mixture under conditions adequate to at least partially abrade the surface portion. An example sprayer system for abrading a concrete surface is also provided. The system includes an aqueous-based particulate abrasive mixture dispenser including a spray nozzle arrangement. The system also includes a material communication assembly in abrasive flow communication with the aqueous-based particulate abrasive mixture dispenser. The system also includes a dispenser positioning arrangement.

17 Claims, 16 Drawing Sheets

(51) Int. Cl.

| | |
|---|---|
| ***B24C 7/00*** | (2006.01) |
| ***B24C 11/00*** | (2006.01) |
| ***E04B 1/04*** | (2006.01) |
| ***E04G 21/00*** | (2006.01) |
| ***B24C 1/04*** | (2006.01) |
| ***B24C 1/06*** | (2006.01) |
| ***B24C 3/32*** | (2006.01) |

(52) U.S. Cl.
CPC ..... *B24C 5/04* (2013.01); *B24C 7/0023* (2013.01); *B24C 7/0038* (2013.01); *B24C 11/00* (2013.01); *E04B 1/04* (2013.01); *E04G 21/00* (2013.01)

(58) Field of Classification Search
CPC . B24C 11/00; E04B 1/04; E04B 21/00; E03G 21/00
USPC ..... 451/40
See application file for complete search history.

(56) References Cited

U.S. PATENT DOCUMENTS 3,298,052 A * 1/1967 Wolfe ..... A47L 1/02 15/103
3,550,321 A 12/1970 Dye, Jr.
4,199,358 A * 4/1980 Parsons ..... B24C 1/04 101/129
4,703,591 A * 11/1987 Herrington ..... B24C 1/045 451/40
5,042,208 A * 8/1991 Richardson ..... B23Q 9/0014 451/354
5,240,503 A 8/1993 Levy et al.
5,367,841 A * 11/1994 Smith ..... B24C 3/062 451/87
5,586,927 A 12/1996 Herbert
5,709,587 A * 1/1998 Shaffer ..... B24B 1/00 451/38
5,716,261 A * 2/1998 Watkin ..... B24C 3/062 451/75
5,772,496 A * 6/1998 Kurtz ..... B24B 19/26 451/296
6,092,517 A * 7/2000 Schanel ..... E04F 21/16 125/23.01
6,675,548 B2 * 1/2004 Bristol ..... B24C 1/06 239/11
6,997,780 B2 2/2006 Pieper
8,298,347 B2 * 10/2012 MacNeil ..... B08B 3/024 134/172
8,790,163 B2 * 7/2014 Ke ..... E04F 21/32 15/49.1
8,894,467 B2 * 11/2014 Santure ..... B24C 3/04 451/2
9,393,672 B2 7/2016 Eliason
9,744,644 B2 * 8/2017 Spires ..... B24C 1/06
9,827,650 B2 * 11/2017 Santure ..... B24C 3/04
2008/0261493 A1 10/2008 Fahnle et al.
2010/0003894 A1 * 1/2010 Miller ..... B24C 1/04 451/5
2010/0215907 A1 8/2010 Spires
2014/0170937 A1 6/2014 Sugimoto et al.
2015/0111473 A1 * 4/2015 Geyer ..... B24C 1/10 451/40

OTHER PUBLICATIONS

International Search Report and Written Opinion for Application No. PCT/US2017/045099 dated Oct. 25, 2017.

* cited by examiner

DETAIL A
SCALE 2 : 15

DETAIL B
SCALE 2 : 15

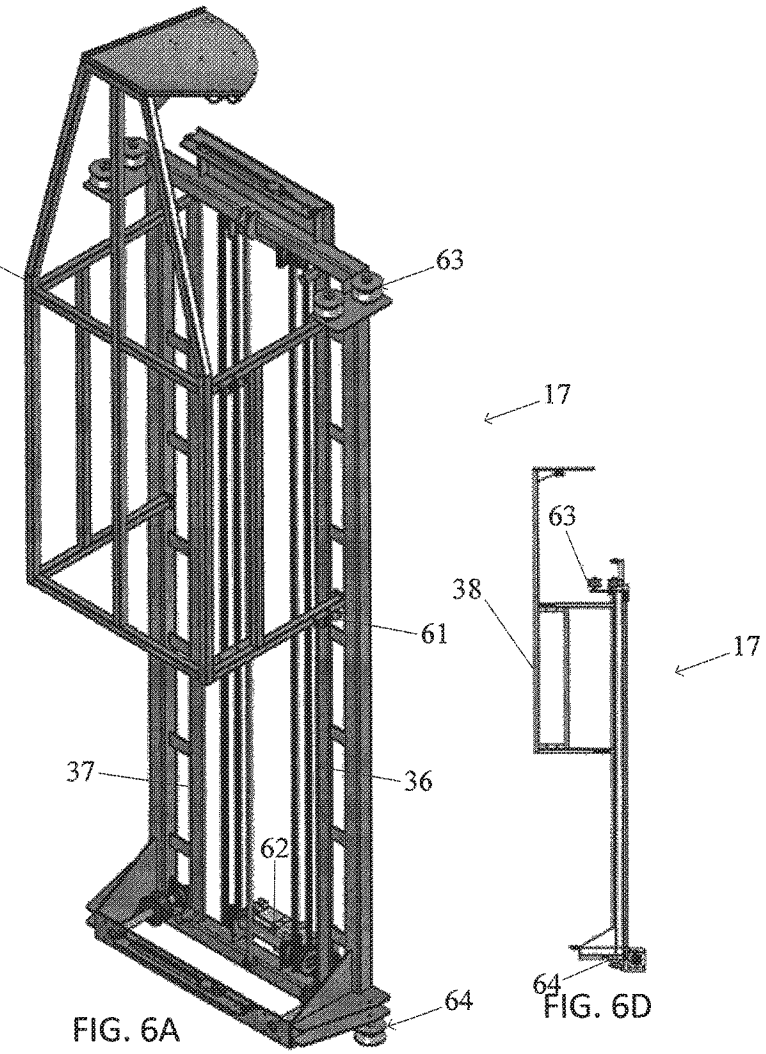
FIG. 6D
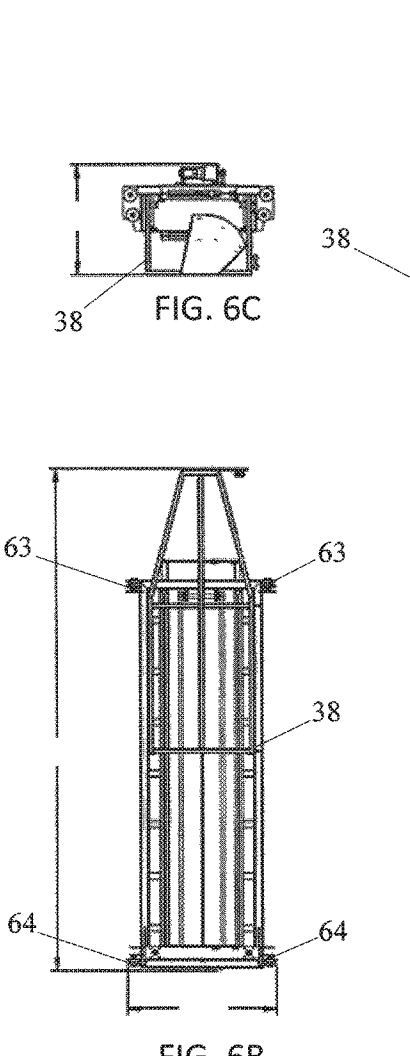
FIG. 6A
FIG. 6C
FIG. 6B

111

114

APPARATUS, COMPONENTS, METHODS AND SYSTEMS FOR USE IN SELECTIVELY TEXTURING CONCRETE SURFACES

CROSS-REFERENCE TO RELATED APPLICATIONS

The present application includes the disclosure of, with edits and additions, U.S. provisional 62/371,096, filed Aug. 4, 2016. A claim of priority is made to U.S. provisional 62/371,096 to the extent appropriate. In addition, U.S. provisional 62/371,096 is incorporated herein, by reference, in its entirety.

FIELD OF THE DISCLOSURE

The present disclosure relates to providing a surface portion of an architectural precast concrete wall panel with an abraded texture. Example methods of providing the abraded texture include a step of spraying a surface portion of an architectural precast concrete wall panel with an aqueous-based particulate abrasive mixture. The equipment described includes an aqueous-based particulate abrasive mixture dispenser and a material communication assembly in abrasive flow communication with the aqueous-based particulate abrasive mixture dispenser.

BACKGROUND

Architectural precast concrete wall panels are used in construction of buildings and other structures. The term "architectural precast concrete wall panels" and variants thereof as used herein refers to concrete panels that are used in forming walls that have a perimeter area of at least twenty square feet. The term "perimeter area" and variants thereof as used herein refers to the area circumscribed by an outer perimeter of the surface panel. Thus, the perimeter area is determined without consideration of any apertures through the surface.

Architectural precast concrete wall panels are typically fabricated in a factory or another location that is remote from a construction (building) site where the wall panels will be used. The wall panels are then transported to the construction site (e.g., on a truck bed). At the construction (building) site, the wall panels are erected and secured to one another to form walls of a building.

Precast concrete wall panels are formed by pouring concrete slurry into a mold that has the desired shape of the wall panel. Concrete slurry is a mixture of cement paste and aggregate material. The cement paste is usually formed from water and Portland cement powder. The aggregate material comprises granular material such as sand, gravel, or crushed stone. In the concrete slurry, the cement paste coats the granules of the aggregates and fills voids between the granules. Once mixed, the concrete slurry begins to harden.

Although alternatives are possible, the wall panels have a generally rectangular shape with a width of at least 4 feet (or 1 meter), often in the range of 4-15 fifteen feet (or 1-5 meters) inclusive, and a length of at least 10 feet (or 3 meters), often in the range of 10-50 feet (or 3-16 meters) inclusive. The wall panels are not limited to rectangular shapes though and can include various cutouts for aesthetic/design purposes (e.g., arches or points for a roof line) or for functional purpose (e.g., openings for doors, windows, etc.). Typically, the wall panels have a thickness of at least 3 inches (or 7 centimeters), often in a range of 3-9 inches (or 7-23 centimeters) inclusive, and sometimes even thicker.

Various materials can be added to the concrete. For example, steel rods, cables, or meshes can be added to reinforce the concrete. Insulating materials can also be added. In some cases, the wall panel is formed from multiple layers of concrete separated by a layer of foam insulation. The concrete panel can comprise prestressed concrete if desired.

The wall panels can be formed to have various surface textures, which may be desired for aesthetic or functional purposes. Textures can be produced by spraying an acid wash on the wall panel. The acid wash will abrade the surface of the wall panel, leaving behind a texture. Unfortunately, managing the chemicals used in the acid wash can be time consuming and expensive. Textures can also be produced using dry sand blasting equipment. However, typical dry sand blasting approaches can fill the air with dry particulate matter, which then be managed.

The present application relates to methods, techniques, and equipment for providing a surface portion of an architectural precast concrete wall panel with an abraded texture that overcome the shortcomings of such past approaches as using an acid wash or sand blasting for the abrading.

SUMMARY

In accord with the present disclosure, in general the methods, techniques, and systems characterized herein relate to selectively texturing surfaces, such as surfaces of architectural precast concrete wall panels using spray material dispensing equipment. The spray material will typically be an aqueous-based particulate abrasive mixture. In many applications, the spray material dispensing system includes a spray nozzle assembly that is automatically moved or aimed at different portions of a surface.

It is noted that in some instances, it is desired to provide a pressure washer arrangement in equipment used with precast concrete pieces, in which a pressure washer is used (through direction of spray nozzles) to clean the surface of the precast concrete from blast debris, to remove wax film or to blast uncured concrete from a retarder process. Various systems provided herein can be adapted to include such pressure washer and nozzle arrangements therewith, and to apply such techniques to the concrete slabs whether or not the surfaces are also being abraded.

BRIEF DESCRIPTION OF THE DRAWINGS

FIG. 6A is a schematic orthographic view of an example vertical guide rail assembly usable in accord with certain systems and techniques according to the present disclosure.

FIG. 6B is a schematic back view of an example vertical guide rail assembly in accord with FIG. 6A.

FIG. 6C is a schematic top view of an example vertical guide rail assembly in accord with FIG. 6A.

FIG. 6D is a schematic side view of an example vertical guide rail assembly in accord with FIG. 6A.

DETAILED DESCRIPTION

I. General Principles

Figure 1:
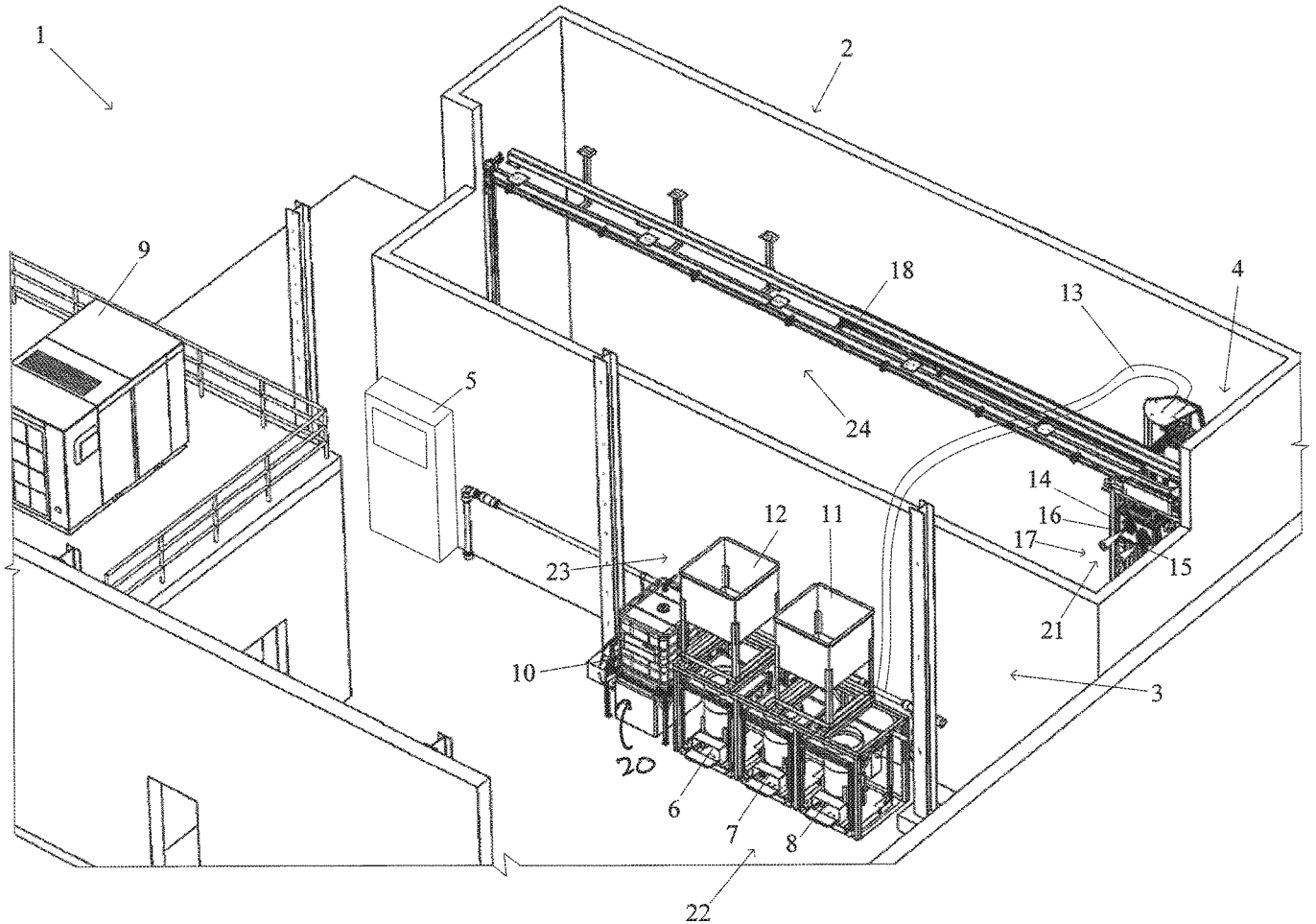
FIG. 1 is a schematic depiction of a fabrication site for selectively texturing a concrete surface.

In general, the techniques described herein can be applied to equipment for producing textures on surfaces of products at a factory or another type of worksite. For example, the techniques can be applied to produce a texture on a region of a surface of an architectural precast concrete wall panel with a vapor abrasive blasting material.

Example Methods and Materials for Selectively Texturing Concrete Surfaces

In an example, concrete is selectively textured by spraying a surface portion of the concrete, such as an architectural precast concrete wall panel, with an aqueous-based particulate abrasive mixture under conditions adequate to at least partially abrade the surface portion. Depending on the application, the spraying is sometimes referred to as vapor abrasive blasting. As used herein, the term "vapor abrasive blasting" and variants thereof means spraying an aqueous-based particulate abrasive mixture. The vapor abrasive blasting techniques provided herein produce less dust than traditional dry blasting.

The aqueous-based particulate abrasive mixture includes a mixture of a particulate abrasive material (blasting media) and a liquid (e.g., water with or without additives). Typically, the liquid and particulate abrasive material has a ratio, by volume, of at least 25 parts of particulate abrasive to 1 part liquid and not more than 100 parts of particulate abrasive to 1 part liquid. Although alternatives are possible, the liquid and particulate abrasive material has a ratio, by volume, in the range of 40 to 60, inclusive, parts of particulate abrasive to 1 part liquid.

The liquid is water with or without additives. Typically, the liquid is not acidic and does not include any acidic additives. Typically, the pH of the liquid is at least 6. Although alternatives are possible, the pH of the liquid is typically no greater than 8. Often, the pH of the liquid is at least 6.5 and no greater than 7.5 although alternatives are possible.

The particulate abrasive is typically composed of abrasive particulate materials such as sand, garnet, crushed glass, or mixtures thereof. The abrasive particulate can be characterized in part by Mohs hardness values. Although alternatives are possible, the garnet typically has a Mohs hardness value of at least 7 and often no more than 8. The crushed glass often has a Mohs hardness value selected from the range of 5.5 to 6.5, inclusive, although alternatives are possible.

The particulate abrasive material can be characterized by bulk density. Bulk density is calculated by dividing the dry weight of the particulate abrasive material by its volume. When spraying a particulate abrasive consisting of crushed glass, the crushed glass often has a bulk density that is at least 75 lbs./cubic foot (or 1200 kg/cubic meter), although alternatives are possible. Often the crushed glass has a bulk density that is no greater than 85 lbs./cubic foot (or 1370 kg/cubic meter). When spraying a particulate abrasive consisting of garnet, the garnet typically has bulk density that is at least 75 lbs./cubic foot (or 1200 kg/cubic meter). Although alternatives are possible, the garnet often has a bulk density no greater than of about 80 lbs./cubic foot (or 1370 kg/cubic meter).

The particulate abrasive material can also include particulate matter of various sizes and shapes. Typically, it will be preferred that the particulate matter not be too round. The shapes of the particulate abrasive material can be characterized by the roundness of the particulate. Roundness is a measure of the sharpness of the particulate's corners and edges. Roundness can be calculated as a ratio of the average radius of the edges or corners of a particulate abrasive to the radius of the maximum inscribed sphere. Spraying the aqueous-based particulate abrasive mixture can include spraying a mixture in which at least 95% by weight of the particulate abrasive material has an angular (roundness: no greater than 0.15) or sub-angular (roundness: 0.15-0.25) shape.

The size of the particulate abrasive material can be characterized by the size of mesh through which the particulate would pass. Spraying the aqueous-based particulate abrasive material can include spraying a mixture in which at least 95% by weight of the particulate abrasive material is sized to pass through a mesh size of at least 4 openings per linear inch (or 1 opening per linear centimeter) or 10 openings per linear inch (or 3 openings per linear centimeter) and of no greater than 20 openings per linear inch (or 8 openings per linear centimeter) or 100 openings per linear inch (or 40 openings per linear centimeter).

The pressure at which the aqueous-based particulate abrasive mixture is sprayed is selected based on the desired surface texture. Equipment that is adapted for spaying the aqueous-based particulate abrasive mixture, such as an ECOQUIP EQ600s vapor abrasive blast equipment from Graco, Inc. of Minneapolis, Minn. 55413, is typically capable of spraying material at pressures between 30-140 pounds per square inch (psi) (or 200-1000 kPa) inclusive, although alternatives are possible.

Typically, a wall panel will have two non-edge sides. The non-edge sides are defined by the perimeter (outer) edges of the wall panel. As used herein, the term "surface portion" and variants thereof refers to at least some of the surface of a non-edge side of a wall panel. A surface portion can refer to the entire surface of a non-edge side of a wall panel or a lesser portion of the non-edge side.

The techniques described herein can be used to apply a surface texture to a selected portion of a surface portion. As used herein, the term "selected portion" and variants thereof refers to a contiguous portion of a surface portion of a wall panel. Although alternatives are possible, the selected portion is typically at least 4 square feet (or 0.3 square meters), although it is often at least 8 square feet (or 0.6 square meters), or even at least 16 square feet (or 1.2 square meters).

The selected portion of the wall panel can be prepared with a light texture (exposure), a medium texture (exposure), or a heavy texture (exposure). The term "light texture" and variants thereof as used herein means a texture generated by abrading the surface portion such that no greater than 25% of the abraded surface portion is abraded to expose aggregate embedded in the architectural precast concrete wall panel. For example, a wall panel with a light texture has a surface film of cement paste removed from the concrete, exposing edges of course aggregate embedded in the concrete. Typically, when abrading to a light texture, the spraying is at a pressure of no greater than about 35 psi (or 250 kPa).

The term "medium texture" and variants thereof as used herein means a texture generated by abrading the surface portion such that more than 25% and less than 75% of the abraded surface portion is sufficiently abraded to expose aggregate embedded in the architectural precast concrete wall panel. Although alternatives are possible, the abraded surface portion is typically at least 4 square feet (or 0.3 square meters). A wall panel with a medium texture has more cement paste removed from the surface than the light texture, exposing approximately equal amounts of aggregate and cement paste. Typically, when abrading to a medium texture, the spraying is at a pressure of no greater than about 80 psi (or 550 kPa).

The term "heavy texture" and variants thereof as used herein means a texture generated by abrading the surface portion such that at least 75% of the abraded surface portion is sufficiently abraded to expose aggregate embedded in the architectural precast concrete wall pane. Although alternatives are possible, the abraded surface portion is typically at least 4 square feet (or 0.3 square meters). A wall panel with a heavy texture has most of the cement paste on the surface removed, leaving primarily aggregate exposed. Typically, when abrading to a heavy texture, the spraying is at a pressure of no greater than about 130 psi (or 900 kPa).

Of course, the number of types of textures and specific regions of textures that can be obtained with techniques according to the present disclosure is subject to infinite variation, depending on the choice of the user. The above are meant to indicate variations that can be viewed as different classes or sets of techniques.

It is noted that in general, a finish texture is not necessarily simply a matter of the variables identified previously, although those are the ones in which focus is placed in accord with the present disclosure. Finish texture will typically be controlled/managed by nozzle speed, distance of separation of the nozzle from the work surface, wobble of the nozzle during use, and other described variations.

It is also noted that exposed aggregate finish can be accomplished by using retarder during the concrete production process and using a power wash function to water blast the retarder, in a system in accord with the present disclosure.

Examples of Sprayer System and Associated Techniques

Examples of the sprayer system for abrading a concrete surface include various types of spray dispensing equipment that can spray an aqueous-based particulate abrasive mixture under conditions adequate to at least partially abrade a surface portion of concrete. In an example, the sprayer system is configured to sufficiently mix a small amount of liquid with an abrasive particulate material so that the liquid encapsulates the abrasive particulate. The sprayer system is then used to spray a spray material against a concrete surface, such as a selected portion of a surface portion of an architectural precast concrete wall panel. When the surface is struck by a sufficient amount of spray material under sufficient conditions, a portion of the surface (e.g., cement paste) is abraded, exposing an interior of the product, such as aggregate embedded in the concrete. Various properties of the sprayer system can be adjusted to alter the texture generated on the surface of the concrete. For example, spraying using a higher pressure setting will generate a heavier (rougher) texture on the surface, while using a lower pressure setting will generate a lighter (smoother) texture on the surface. Other parameters of the sprayer system can also be varied to alter the texture that is produced on the surface (e.g., different types of material can be dispensed). Typically, the textures are applied for aesthetic purposes, to allow another coating or surface treatment to be applied thereon, or for other reasons.

The examples described herein often relate to the production of a texture on a surface portion of an architectural precast concrete wall panel. However, it should be understood that the techniques described can also be applied to various other products and in various other settings. One of the last steps in fabricating a concrete panel is to produce a texture on the surface of the concrete panel. Generally, the concrete panel is placed in a spray chamber (room) where the panel is sprayed to produce a desired texture on the surface of the panel. The panel can be brought into the spray chamber with a trolley, crane, hoist, or other machinery for lifting and positioning the panel.

Examples of Material Communication Assembly

The sprayer system includes a material communication assembly that mixes an abrasive particulate media with liquid and delivers a pressurized mixture of wet abrasive particulate media to one or more spray nozzle arrangements in a dispenser. The material communication assembly is connected to the dispenser so as to allow abrasive flow communication to the dispenser. Allowing abrasive flow communication with the dispenser means that that material communication assembly is capable of allowing the aqueous-based particulate abrasive mixture to flow to the dispenser. It should be understood, however, that allowing abrasive flow communication does not require abrasive flow communication but merely requires that the material communication assembly be capable of allowing abrasive flow communication.

The material communication assembly can be adapted from equipment, which is sometimes characterized as a blast pot depending on the nature of the material being delivered and is manufactured by a variety of companies, including for example, Graco, Inc. of Minneapolis, Minn. 55413. The material communication assembly can be a single piece of equipment or multiple pieces of equipment. For example, multiple material communication assemblies can be used to independently deliver material to each spray nozzle arrangement when the connected dispenser includes multiple spray nozzle arrangement.

The material communication assembly is connected to one or more containers (hoppers) that are for holding the abrasive particulate media and a liquid tank for holding a liquid to mix with the abrasive particulate media. The material communication assembly is also connected to an air compressor or another source of pressurized air. In operation, the communication assembly mixes the abrasive particulate media and the liquid at a desired ratio to form an aqueous-based particulate abrasive mixture and then delivers the mixture to the dispenser via a conduit (material communication line) such as a flexible hose.

It is noted that the equipment can be configured so that a distance of the nozzles from one another and/or from the workpiece can be adjusted through automatic programming, for different panel thickness by using proximity sensors and other equipment. The systems can be configured to adjust while applying finish to account for panel alignment variations.

Examples and Techniques Related to the Aqueous-Based Particulate Abrasive Mixture Dispenser The sprayer system includes a spray nozzle arrangement that can spray material at a concrete surface. Although alternatives are possible, in the examples described herein, the spray nozzle arrangement is mounted on an aqueous-based particulate abrasive mixture dispenser. The spray nozzle arrangement can include one or more spray nozzles that are oriented (aimed) in directions that are approximately parallel with each other.

The dispenser can adjust the spray nozzle arrangement to alter the aim of the one or more spray nozzles. Although alternatives are possible, the dispenser can include a spatial attribute adjustment motor assembly. The spatial attribute adjustment motor assembly can alter the spay nozzle arrangement by adjusting one or both of the position and orientation of the spray nozzles relative to the dispenser.

For example, the motor assembly can cause the spray nozzles to oscillate or wobble. The oscillation causes the spray nozzles to spray, during an oscillation, the aqueous-based particulate abrasive against a contact region of the concrete surface that is larger than would be contacted if the spray nozzles were stationary relative to the dispenser assembly. Preferably, the oscillation is in a two-dimensional pattern that is not linear. Typically, the oscillation is in a round pattern that is ovoid or approximately circular motion. A circular oscillation causes the material emitted by the one or more spray nozzles to abrade approximately circular-shaped regions on the concrete surface.

In embodiments that include multiple spray nozzles, the position of the spray nozzles on the dispenser are typically offset from each other such that the contact regions of material emitted by the nozzles approximately abut (or slightly overlap) each other. In this manner, the rate at which the dispenser assembly can spray the surface portion of the concrete is increased.

The dispenser assembly can include a depth adjustment system that moves the spray nozzle arrangement toward or away from the target concrete surface. In other words, the depth adjustment system moves the spray nozzle arrangement in a direction that is approximately parallel to the direction of spray or tangent to the surface of the target. The depth adjustment system can include a linear actuator, such as a pneumatic arm, that pushes/pulls the spray nozzle arrangement toward or away from the target concrete surface. Alternatively, the dispenser assembly is mounted on a rail that is oriented in the direction of the intended target location on linear motion bearings that allow movement along the rail toward or away from the target. In this manner, the dispenser assembly can adapt to spray surface portions of architectural precast concrete wall panels of a variety of different thicknesses by repositioning the nozzles so that spraying is performed from the same distance from the target regardless of the thickness of the target. For example, architectural precast concrete wall panels often have thicknesses of between 3-9 inches (7-22 centimeters) inclusive or more.

Examples and Techniques Related to Dispenser Positioning Arrangement

A dispenser positioning arrangement can automatically alter the position of the aqueous-based particulate abrasive mixture dispenser relative to a concrete surface. The dispenser positioning arrangement uses machine power to direct and move the aqueous-based particulate abrasive mixture dispenser. In an example, the dispenser positioning arrangement can move the dispenser in two dimensions that define a plane that is approximately parallel to the concrete surface. For example, the dispenser positioning arrangement includes a first position adjustment system that adjusts the position of the dispenser along a first axis of the plane. The dispenser positioning arrangement also includes a second position adjustment system that adjusts the position of the dispenser along a second axis of the plane that is approximately perpendicular to the first axis. Although alternatives are possible, in the example disclosed herein, the first axis is a vertical axis and the second axis is a horizontal axis. In this manner, the two position adjustment systems can together position (move) the dispenser in two dimensions across a surface of the panel.

Various techniques can be used in the dispenser positioning equipment. One technique includes a framework having a first guide rail assembly oriented to the axis of the first position adjustment system and a second guide rail assembly oriented to the axis of the second position adjustment system. The dispenser assembly is connected to the first guide rail assembly via a linear motion bearing that allows the dispenser assembly to move linearly along the first axis. So, for example if the first axis is vertical, the dispenser assembly can be moved up and down the first guide rail assembly by a linear actuator (e.g., a servomotor or a motorized pulley or winch system) to adjust the vertical position of the dispenser assembly. The first guide rail assembly is connected to the second guide rail assembly via linear motion bearings that allow the entire first guide rail assembly to be moved along the second guide rail assembly by another linear actuator.

Example Techniques for Controlling the Spray Dispensing Equipment

The sprayer system can include control equipment. The control equipment controls the operation of the spray system, including the aqueous-based particulate abrasive mixture dispenser, the dispenser assembly, and the dispenser positioning arrangement. The control equipment transmits control signals to cause the abrasive mixture dispenser to produce and deliver the aqueous-based particulate abrasive mixture to the dispenser, to cause the dispenser to cause the spray nozzle arrangement to oscillate and spray the mixture, and to cause the dispenser positioning arrangement to move the dispenser across a plane that is approximately perpendicular to a target concrete surface.

Although alternatives are possible, the control equipment can include a computer that transmits control signals to various components of the sprayer system. For example, the control equipment can transmit control signals that activate and control the pressure and delivery of material provided by the material delivery equipment. Additionally, the control equipment can transmit control signals to the dispenser positioning equipment to adjust the position of the dispenser assembly.

The control equipment typically accesses job data about a current job target (e.g., an architectural precast concrete wall panel). The job data can be loaded from a local data store or a data store available over the network. The job data is often associated with a job identifier that is entered by an operator of the sprayer system (e.g., by typing a numeric identifier, selecting an entry in a list displayed on a screen, scanning a barcode, or otherwise). Alternatively, the control equipment can read the job identifier from the target directly (e.g., from a radio frequency identification (RFID) tag, using near field communication, or by scanning a barcode or similar identifier affixed to the target). The job data can define spray parameters such as a spray pressure for the target. The job data can also divide the target into multiple regions that can have different spray parameters. In this manner, the surface on the job target can have different textures that, for example, add an aesthetic strip or pattern to the building that is ultimately constructed with the architectural precast concrete wall panels. Additionally, the job data can also define regions that are not to be sprayed at all (e.g., openings in the panel where windows or doors will be installed at the building site).

In some examples, the job data defines a motion path for the dispenser to follow to produce the desired texture on the target or in the regions of the target. Alternatively, the control equipment determines a motion path for the dispenser based on the dimensions of the target or regions therein.

As an example, the motion path can include a plurality of horizontal line segments that are offset from one another vertically. The line segments may start on one side of a selected region of the target concrete surface and end on the opposite end of the selected region. The control equipment then transmits various control signals to the sprayer system to cause the dispenser positioning equipment to position the dispenser to follow the motion path while the aqueous-based particulate abrasive mixture is sprayed at the surface portion of the job target using the dispenser. For example, the control equipment can send a control signal to cause the dispenser position system to move the dispenser horizontally along the horizontal guide rail from one end of a horizontal line segment to another. After the dispenser reaches the end of the horizontal line segment, the control equipment can send a control signal to cause the dispenser to move to a start point of a second horizontal line segment (e.g., by causing the dispenser to move vertically up or down). The control equipment can then cause the dispenser to move along the second horizontal line segment.

The control equipment can also transmit a speed control signal that controls the speed of the horizontal movement of the dispenser positioning system. Typically, the speed of the movement is selected based on the desired surface texture and the spray pressure. Although alternatives are possible, if a light or medium texture is desired, a speed of no greater than 20 inches/second (or 51 cm/second) is typically selected. Although alternatives are possible, a speed of at least 0.5 inches/second (or 1 cm/second) is often selected.

If a heavy texture is desired, a speed of at least 1 inch/second (or 2.54 cm/second) is typically selected. Often, a speed no more than 20 inches/second (or 50.8 cm/second), inclusive, is selected, although alternatives are possible. Because the heavy texture is typically applied using a higher pressure, the dispenser can and often should move slower across the concrete surface.

B. An Example of the Techniques and a System of Use

A typical system of use and application of techniques according to the present disclosure can be understood from reference to FIGS. 1-7. FIGS. 1-7 relate to an example involving a sprayer system being used to generate a texture on a surface of an architectural precast concrete wall panel. The techniques and systems described herein are also applicable to other types of concrete surfaces.

Referring first to FIG. 1, a schematic depiction of a fabrication site for selectively texturing a concrete surface is provided. Referring to FIG. 1, at 1, a sprayer system is generally indicated. A spray chamber is generally indicated at 2. The spray chamber 2 is a chamber, such as room, in which the architectural precast concrete wall panels are placed for the purpose of generating a texture on a surface thereof. As the architectural precast concrete wall panels are usually quite large, the spray chamber is also typically quite large so as to contain the wall panels. Typically, at least a portion of the sprayer system is located in the spray chamber and is secured to the chamber (e.g., the floor and ceiling of the chamber) in a manner that would make it quite difficult to relocate the sprayer system. Instead, the wall panels are moved into the chamber and positioned so that the sprayer system can spray a surface portion thereof. Various type of equipment, such as trolleys or hoists, can be used to position the wall panels within the spray chamber.

The system 1 can spray a surface portion of an architectural precast concrete wall panel with an aqueous-based particulate abrasive mixture under conditions adequate to at least partially abrade the surface portion. The system 1 would typically include, provided therewith, at least the following: an aqueous-based particulate abrasive dispenser (dispenser assembly) 14; a material communication assembly 3 that delivers spray material to the aqueous-based particulate abrasive dispenser 14; a dispenser positioning arrangement 4 that includes machinery to position the aqueous-based particulate abrasive dispenser 14; and control equipment 5; and various material containers and material communication assemblies.

The aqueous-based particulate abrasive dispenser 14 receives the aqueous-based particulate abrasive mixture and sprays it into a selected portion of a concrete surface under conditions adequate to abrade the selected surface to a desired texture. The aqueous-based particulate abrasive dispenser 14 includes a spray nozzle arrangement 21 with one or more spray nozzles, such as spray nozzle 15 and spray nozzle 16. Although alternatives are possible, the spray nozzle 15 and the spray nozzle 16 are offset from each other. As will be described in more detail herein, the aqueous-based particulate abrasive dispenser 14 can also include an actuator assembly for adjusting where the spray nozzle arrangement 21 (or the spray nozzles therein) are aimed and a depth adjustment assembly for moving the spray nozzle arrangement 21 towards or away from a target concrete surface.

The material communication assembly 3 produces an aqueous-based particulate abrasive mixture and delivers the mixture to the aqueous-based particulate abrasive dispenser 14 under sufficient pressure to abrade the target concrete surface. Although alternatives are possible, in the example herein, the material communication assembly 3 includes a pressurized aqueous-based particulate abrasive production assembly 22; a pressurized gas assembly 9, a liquid holding assembly 10, a material holding assembly 23, and a material communication assembly 13.

The pressurized aqueous-based particulate abrasive production assembly 22 can mix liquid and particulate abrasive (spray or blasting media) at a desired ratio to produce the aqueous-based particulate abrasive mixture. The pressurized aqueous-based particulate abrasive production assembly 22 can then pressurize the aqueous-based particulate abrasive mixture using air pressure.

The pressurized aqueous-based particulate abrasive production assembly 22 includes one or more spray material mixing and dispensing equipment arrangements 6, 7, 8. The spray material mixing and dispensing equipment arrangements 6, 7, 8 (sometimes characterized as blast pots depending on the use) are connected to the pressurized gas assembly 9, the liquid holding assembly 10, and the material holding assembly 23. The spray material mixing and dispensing equipment arrangements 6, 7, 8 mix particulate abrasive material (spray or blasting media) from the material holding assembly 23 with liquid from the liquid holding assembly 10 to form a flowable aqueous-based particulate abrasive mixture. The spray material mixing and dispensing equipment arrangements 6, 7, 8 then use pressurized air from the pressurized gas assembly 9 to pressurize and deliver the aqueous-based particulate abrasive mixture to the aqueous-based particulate abrasive dispenser 14 via the material communication assembly 13. An example of the spray material mixing and dispensing equipment arrangements 6, 7, 8 can be adapted from EcoQuip EQ600s systems from Graco Inc.

The pressurized gas assembly 9 is equipment that provides pressurized gas. An example of the pressurized gas assembly 9 is air compressor. Another example is a pressurized tank. The pressurized gas assembly 9 can includes combinations of one or more air compressors and one or more pressurized tanks. Although alternatives are possible, the pressurized gas assembly typically provides pressurized air.

The liquid holding assembly 10 is a structure that holds a liquid for mixing with the material. Typically, the liquid is water or another aqueous-based liquid. The liquid holding assembly 10 is typically sized to hold at least 50 gallons (or 190 liters) or sometimes much more. Although alternatives are possible, in the example of FIG. 1, the liquid holding assembly 10 is a 275 gallon tank. The liquid holding assembly 10 can, however, be sized to hold different quantities of liquid. The liquid holding assembly 10 can also include multiple tanks.

The material holding assembly 23 is a structure that holds particulate abrasive material (media) that is combined with liquid in the pressurized aqueous-based particulate abrasive production assembly 22 to generate the aqueous-based particulate abrasive mixture (spray material). Although alternatives are available, the example material holding assembly 23 in FIG. 1 includes material containers (hoppers) 11, 12. The material containers can include an open top for receiving the media and a tapered bottom for directing the media to the pressurized aqueous-based particulate abrasive production assembly 22.

The material communication assembly 13 is an assembly that connects the pressurized aqueous-based particulate abrasive production assembly 22 to the aqueous-based particulate abrasive dispenser 14. The material communication assembly 13 can include one or more conduits through which the pressurized spray material flows. For example, the material communication assembly 13 can include flexible hoses.

The dispenser positioning arrangement 4 is a mechanical structure that includes machinery to position the aqueous-based particulate abrasive dispenser 14. The dispenser positioning arrangement 4 uses machine power and machine direction to move the aqueous-based particulate abrasive dispenser 14 relative to a target concrete surface. The dispenser positioning arrangement 4 includes a framework 24 to which the aqueous-based particulate abrasive dispenser 14 is connected.

Although alternatives are possible, in the example shown in FIG. 1, the framework 24 includes a vertical guide rail assembly 17 and a horizontal guide rail assembly 18. The aqueous-based particulate abrasive dispenser 14 is attached to the vertical guide rail assembly 17 with a linear motion bearing assembly that allows the aqueous-based particulate abrasive dispenser 14 to move up and down along the vertical guide rail assembly 17. The vertical guide rail assembly 17 is attached to the horizontal guide rail assembly 18 with a linear motion bearing assembly that allows the vertical guide rail assembly 17 to move horizontally along the horizontal guide rail assembly 18. As will be described further herein, the dispenser positioning arrangement 4 also includes one or more position adjustment systems, such as linear actuators, that use machine power to adjust the position of the aqueous-based particulate abrasive dispenser 14 along the vertical guide rail assembly 17 or the aqueous-based particulate abrasive dispenser 14 and vertical guide rail assembly 17 along the horizontal guide rail assembly 18.

The control equipment 5 controls the operation of the system 1. For example, the control equipment 5 can send control signals to one or more of the material communication assembly 3, the dispenser positioning arrangement 4, and the aqueous-based particulate abrasive dispenser 14. The control equipment 5 can load job parameters for a target (e.g., a particular architectural precast concrete wall panel) of the system 1 to determine how to control the operation of the system 1. The job parameters may be loaded from job data that is stored in a local data store, a remote data store available over a network, or elsewhere. The job parameters can include information such as the dimensions of the target and sometimes the dimensions of regions within the target. The job parameters can also include a width of the target that can be used to control the depth adjustment assembly of the aqueous-based particulate abrasive dispenser 14. The job parameters can also include various spray settings such as a desired spray pressure, mixture settings, spray rate, speed of movement, etc.

In operation, for example, the control equipment 5 sends position control signals to the dispenser positioning arrangement 4 to position the aqueous-based particulate abrasive dispenser 14 at a starting position for the job (e.g., as determined based on the job parameters). Then, the control equipment 5 sends control signals to activate the material communication assembly 3 to begin delivering pressurized spray material to the aqueous-based particulate abrasive dispenser 14; to activate the aqueous-based particulate abrasive dispenser 14 to begin actuating the spray nozzle 15 and the spray nozzle 16; and to the dispenser positioning arrangement 4 to begin moving the aqueous-based particulate abrasive dispenser 14 along a movement path determined based on the job parameters. An example movement path may comprise a series of horizontal lines in alternating directions, in which each line is vertically offset from the previous one. The vertical offset between lines is based on the expected contact region of the spray material on the target. In this manner, the control equipment 5 causes the aqueous-based particulate abrasive dispenser 14 to spray an entire surface of the job target or at least a region thereof.

In FIG. 1 at 20, a pressure wash arrangement included within the equipment is shown. This can be used to generate a pressure spray for various uses during operation of the equipment.

Figure 2:
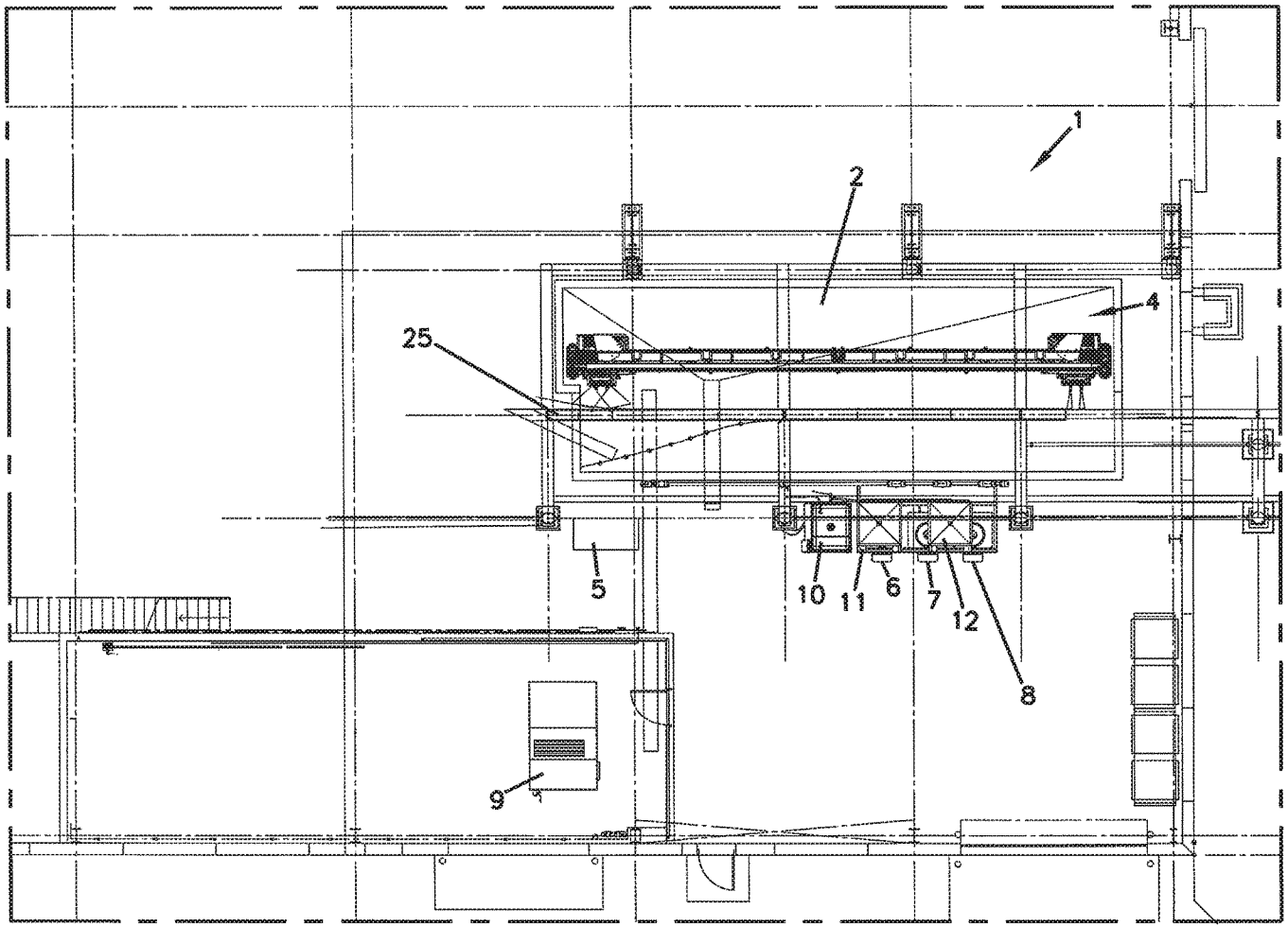
FIG. 2 is a schematic top view of a fabrication site in accord with FIG. 1 that includes a trolley arrangement.

FIG. 2 is a schematic top view of an embodiment of the system 1 that includes a trolley arrangement 25. The trolley arrangement 25 is a mechanical apparatus that positions the target (architectural precast concrete wall panel) for use with the system 1. Although alternatives are possible, the trolley arrangement 25 includes a hoist assembly that is connected to a ceiling mounted rail path with linear motion bearings. The hoist assembly can attach to and lift the target (e.g., an architectural concrete wall panel). The hoist assembly can then move along the rail path to position the target appropriately for spraying with the spray equipment. Depending upon the design of the hoist assembly, the linear motion bearings can slide, roll, or otherwise move along the rail path. The hoist assembly can be moved by a motorized system or by an operator. Other techniques for positioning the target are possible as well. For example, the target could be positioned using a fork lift, a ceiling mounted hoist, a motorized cart, etc.

Figure 3A:
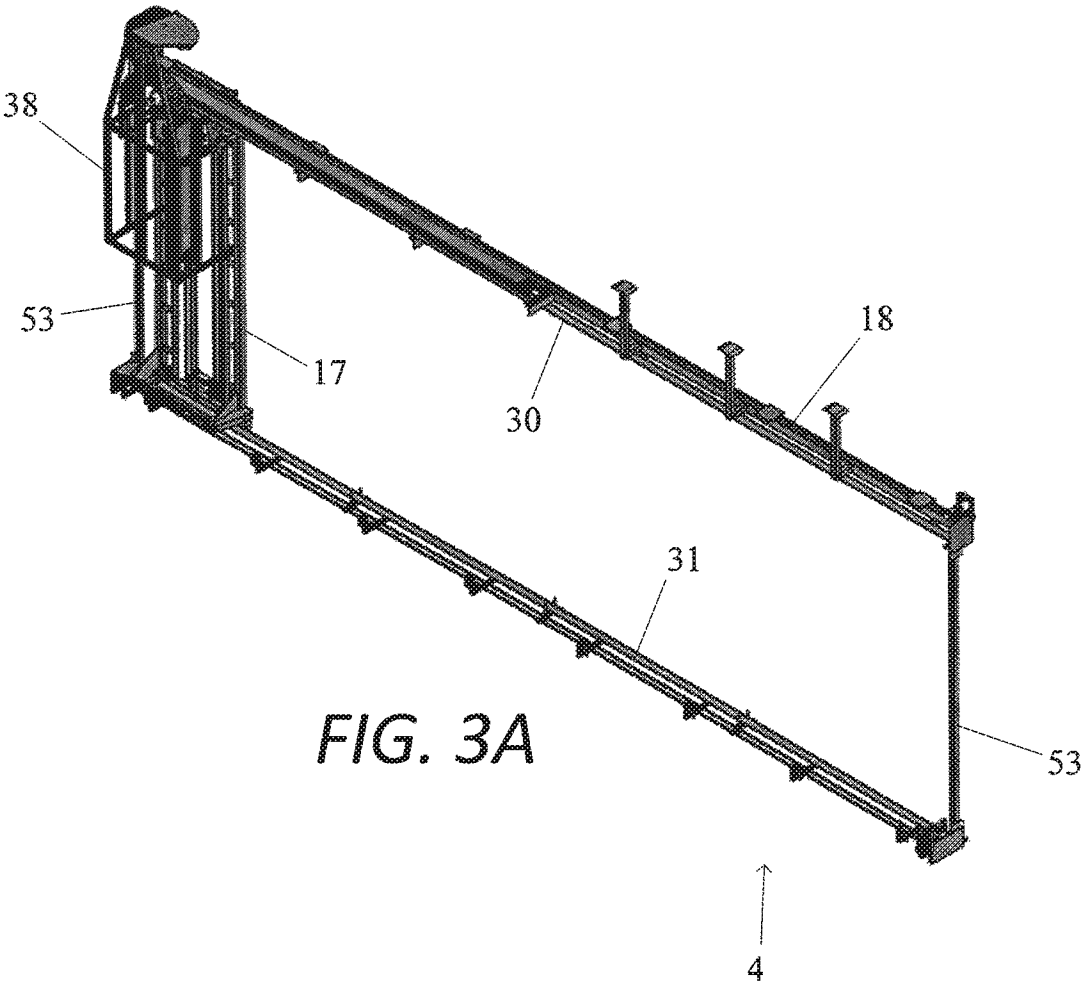
FIG. 3A is a schematic orthographic view of an example dispenser positioning arrangement usable in accord with certain systems and techniques according to the present disclosure.
Figures 3B, 3C, 3D, 3E, 3F, 3G:
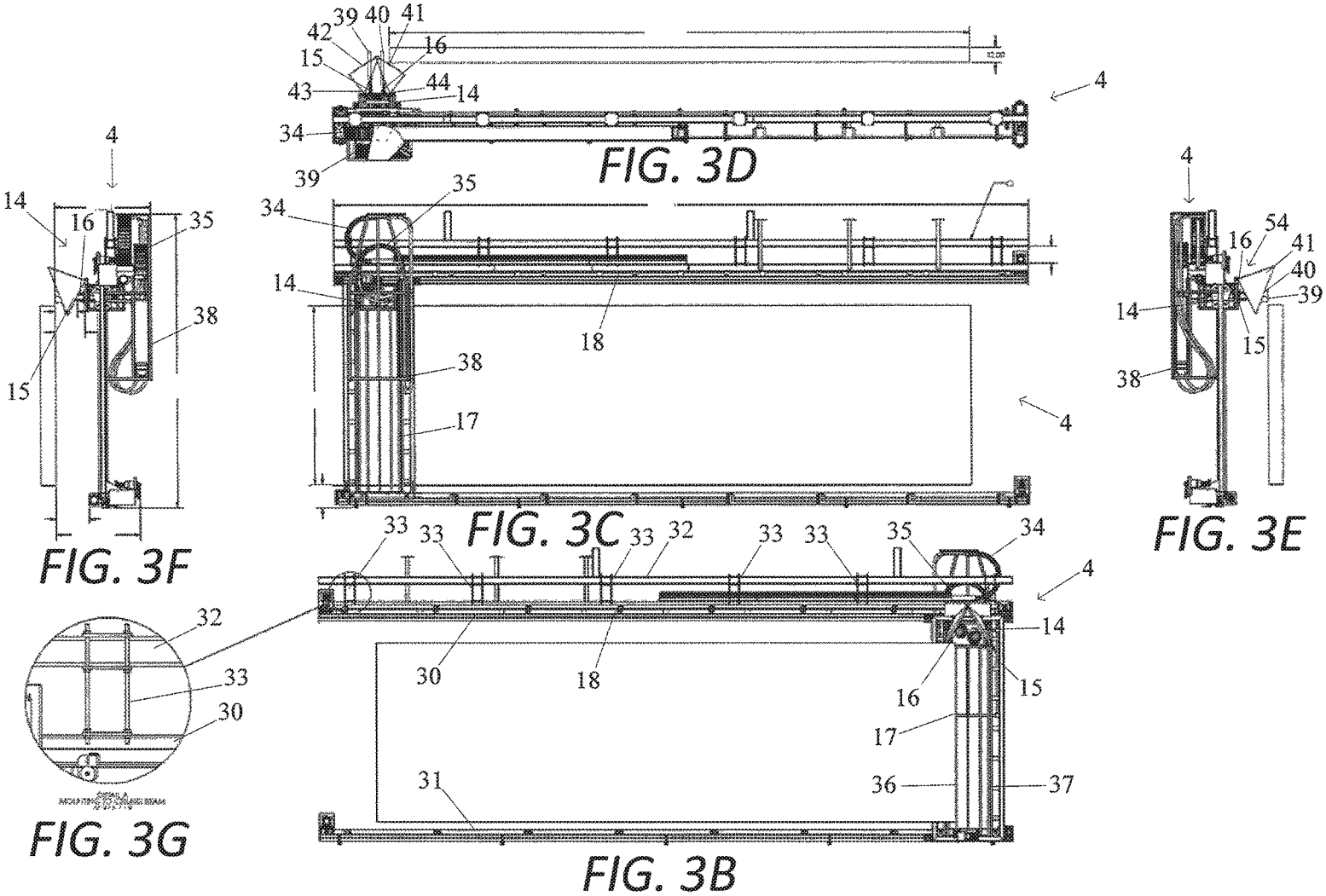
FIG. 3B is a schematic front view of an example dispenser positioning arrangement in accord with FIG. 3A.
FIG. 3C is a schematic back view of an example dispenser positioning arrangement in accord with FIG. 3A.
FIG. 3D is a schematic top view of an example dispenser positioning arrangement in accord with FIG. 3A.
FIG. 3E is a schematic left-side view of an example dispenser positioning arrangement in accord with FIG. 3A.
FIG. 3F is a schematic right-side view of an example dispenser positioning arrangement in accord with FIG. 3A.
FIG. 3G is a schematic top view of an example mounting assembly of the dispenser positioning arrangement in accord with FIG. 3A.

FIGS. 3A-3G are schematic illustrations of the dispenser positioning arrangement 4. More specifically, FIG. 3A is a schematic orthographic view of the example of the dispenser positioning arrangement 4. FIG. 3B is a schematic front view of the example of the dispenser positioning arrangement 4. FIG. 3C is a schematic back view of the example of the dispenser positioning arrangement 4. FIG. 3D is a schematic top view of the example of the dispenser positioning arrangement 4. FIG. 3E is a schematic left-side view of the example of the dispenser positioning arrangement 4. FIG. 3F is a schematic right-side view of the example of the dispenser positioning arrangement 4. FIG. 3G is a schematic top view of an example mounting assembly of the dispenser positioning arrangement 4.

As described previously, the dispenser positioning arrangement 4 includes a vertical guide rail assembly 17 and horizontal guide rail assembly 18. The vertical guide rail assembly 17 is a physical structure that can be used to support and position the dispenser assembly vertically. For example, the aqueous-based particulate abrasive dispenser 14 can be moved up and down along the vertical guide rail assembly 17. Although alternatives are possible, the vertical guide rail assembly 17 includes one or more rail assemblies such as the rail assembly 36 and the rail assembly 37. An enclosure 38 is attached to the aqueous-based particulate abrasive dispenser 14 and is movably coupled to the rail assembly 36 and rail assembly 37. For example, the aqueous-based particulate abrasive dispenser 14 can be enclosed in the enclosure 38, which is a rigid cage-like structure. The enclosure 38 can be coupled to the rail assembly 36 and the rail assembly 37 via linear motion bearings. Then as the enclosure 38 moves up and down along the rail assembly 36 and the rail assembly 37, the aqueous-based particulate abrasive dispenser 14 disposed therein also moves up and down. Alternatively, the dispenser may couple directly to the rail assembly 36 and the rail assembly 37.

The horizontal guide rail assembly 18 is a physical structure that is can be used to support and position the aqueous-based particulate abrasive dispenser 14 horizontally. For example, the aqueous-based particulate abrasive dispenser 14 can be moved side to side along the horizontal guide rail assembly 18. Although alternatives are possible, the horizontal guide rail assembly 18 often comprises an upper guide rail assembly 30 and a lower guide rail assembly 31. In this example, the vertical guide rail assembly 17 is movably attached to both the upper guide rail assembly 30 and the lower guide rail assembly 31. Alternatively, the vertical guide rail assembly 17 can be coupled to only one of the upper guide rail assembly 30 and lower guide rail assembly 31. In this manner, the vertical guide rail assembly 17 can move along the span of the horizontal guide rail assembly 18 to position the enclosure 38 and the aqueous-based particulate abrasive dispenser 14 attached thereto for spraying different portions of the target concrete surface.

Although alternatives are possible, the lower guide rail assembly 31 is mounted to the floor and the upper guide rail assembly 30 is mounted to a beam 32 that is mounted to the ceiling of the spray chamber. The upper guide rail assembly 30 can be mounted to the beam 32 with a mounting bracket assembly 33. Alternatively, the upper guide rail assembly 30 is mounted to the ceiling directly. As another alternative, the upper guide rail assembly 30 is supported by support assembly 53 that is mounted to either the floor or the lower guide rail assembly 31. The support assembly 53 can comprise one or more rigid posts that are mounted vertically between the upper guide rail assembly 30 and lower guide rail assembly 31. In some embodiments, the support assembly 53 is used initially to support the upper guide rail assembly 30 during installation and is then removed after the upper guide rail assembly 30 is securely mounted to the beam 32.

The horizontal guide rail assembly 18 includes a horizontal position adjustment system 34 that moves the vertical guide rail assembly 17 along the upper guide rail assembly 30 and the lower guide rail assembly 31 of the horizontal guide rail assembly 18. The vertical guide rail assembly 17 includes a vertical position adjustment system 35 that moves the enclosure 38 (including the aqueous-based particulate abrasive dispenser 14) up and down along the vertical guide rail assembly 17. Various actuation systems can be used in the horizontal position adjustment system 34 and the vertical position adjustment system 35, including servomotors, pulley systems, hydraulic or pneumatic telescoping arms, chain drives, and belt-based movement systems.

FIGS. 3D-3F illustrate spray (blast) cone 39 and spray (blast) cone 40 generated by the spray nozzle 15 and spray nozzle 16 respectively. The spray cone 39 and the spray cone 40 illustrate the area where the spray material from the aqueous-based particulate abrasive dispenser 14 is (sprayed) dispensed. The spray cone 39 and the spray cone 40 may move relative to the aqueous-based particulate abrasive dispenser 14 as the spray nozzle 15 and the spray nozzle 16 are actuated within the aqueous-based particulate abrasive dispenser 14.

Also shown are wash cone 41 and wash cone 42. Although alternatives are possible, the aqueous-based particulate abrasive dispenser 14 includes a pressure washer nozzle assembly 54 that includes wash nozzle 43 and wash nozzle 44. The wash nozzle 43 and wash nozzle 44 dispense a wash liquid composed of water and sometimes a cleanser to rinse away material and removed concrete after spraying (blasting) with the spray nozzle 15 and spray nozzle 16. The pressure washer nozzle assembly 54 can also be used to remove concrete that has not fully set. For example, a portion of the poured concrete (e.g., a surface) can be treated with a retarder that inhibits the concrete from setting. The pressure washer nozzle assembly can be used to spray away the unset concrete, leaving behind a heavy surface texture. Although alternatives are possible, the wash liquid is often sprayed simultaneously with the aqueous-based liquid particulate abrasive mixture.

As indicated previously, water nozzles can also be used for alternate uses, for example to remove wax residue from the concrete surface if such was applied during the process of manufacture.

Figure 4A:
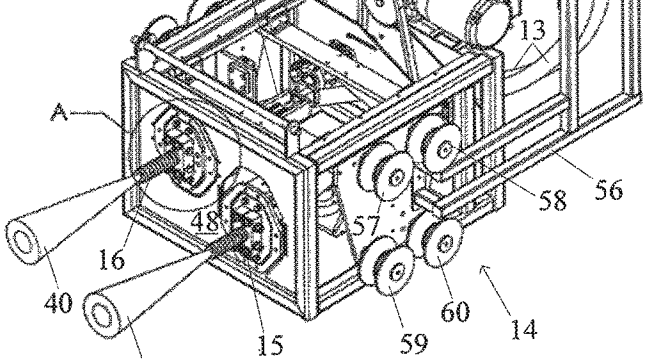
FIG. 4A is a schematic orthographic view of an example spray material dispenser assembly usable in accord with certain systems and techniques according to the present disclosure.
Figure 4B:
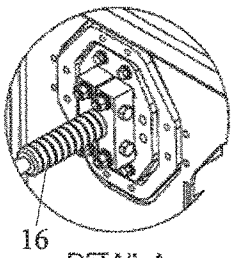
FIG. 4B is a schematic close-up orthographic view of a spray nozzle of an example spray material dispenser assembly in accord with FIG. 4A.
Figure 4E:
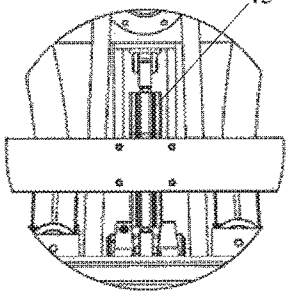
FIG. 4E is a schematic close-up top view of an extension assembly of an example spray material dispenser assembly in accord with FIG. 4A.
Figure 4C:
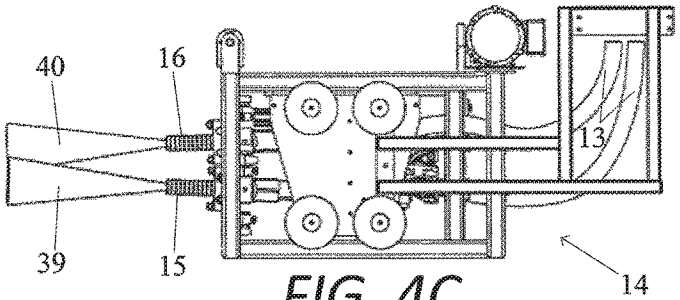
FIG. 4C is a schematic side view of an example spray material dispenser assembly in accord with FIG. 4A.
Figure 4D:
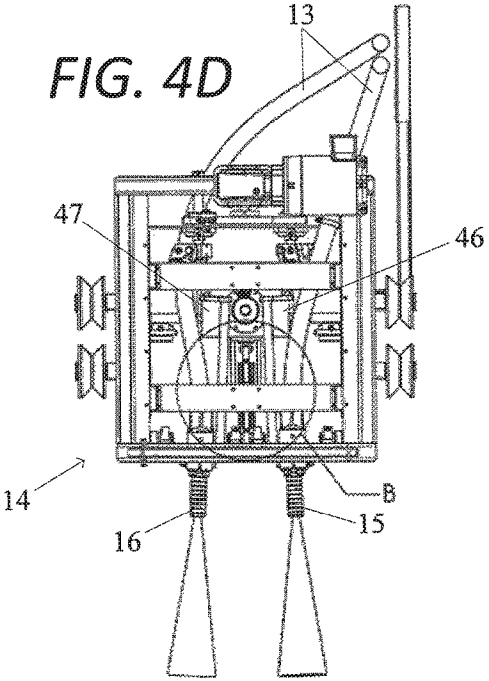
FIG. 4D is a schematic top view of an example spray material dispenser assembly in accord with FIG. 4A.
Figure 4F:
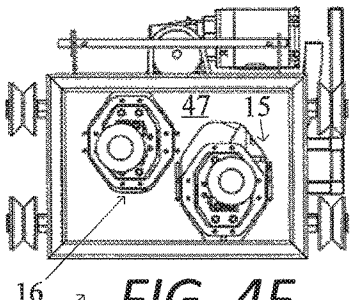
FIG. 4F is a schematic front view of an example spray material dispenser assembly in accord with FIG. 4A.
Figure 5A:
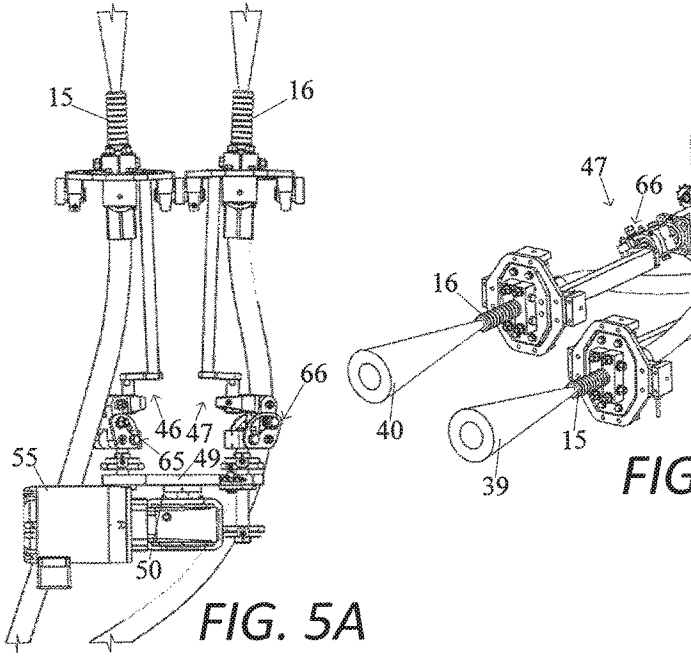
FIG. 5A is a schematic top view of the spray nozzle actuator assembly 55 of an aqueous-based particulate abrasive dispenser in accord with FIG. 4A.
Figure 5B:
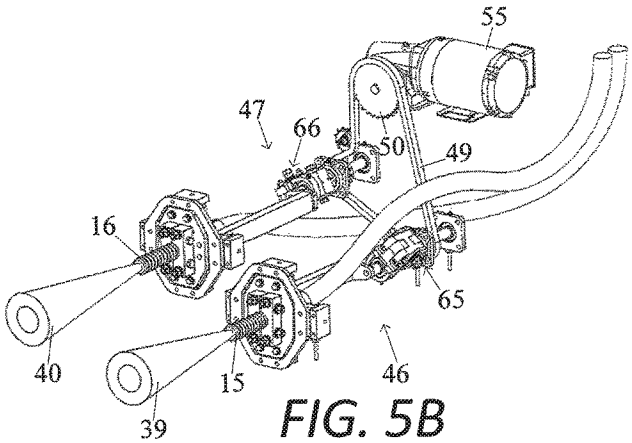
FIG. 5B is a schematic orthographic front view of the spray nozzle actuator assembly 55 of the aqueous-based particulate abrasive dispenser in accord with FIG. 4A.
Figure 5D:
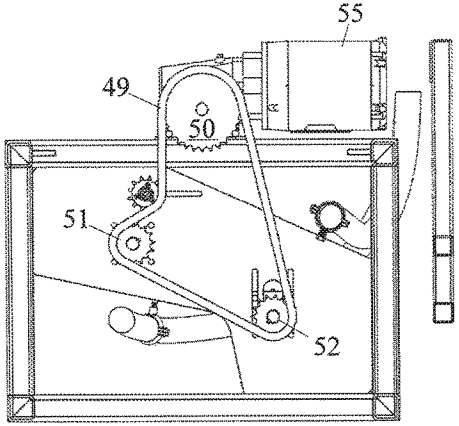
FIG. 5D is a schematic back view of the spray nozzle actuator assembly 55 of the aqueous-based particulate abrasive dispenser in accord with FIG. 4A.
Figure 5C:
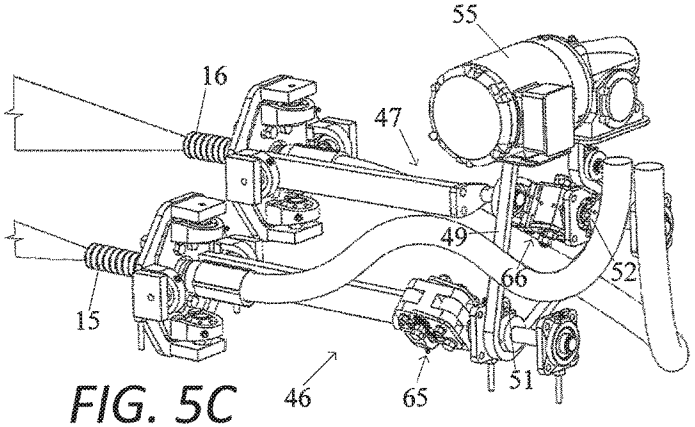
FIG. 5C is a schematic orthography back view of the spray nozzle actuator assembly 55 of the aqueous-based particulate abrasive dispenser in accord with FIG. 4A.
Figure 5E:
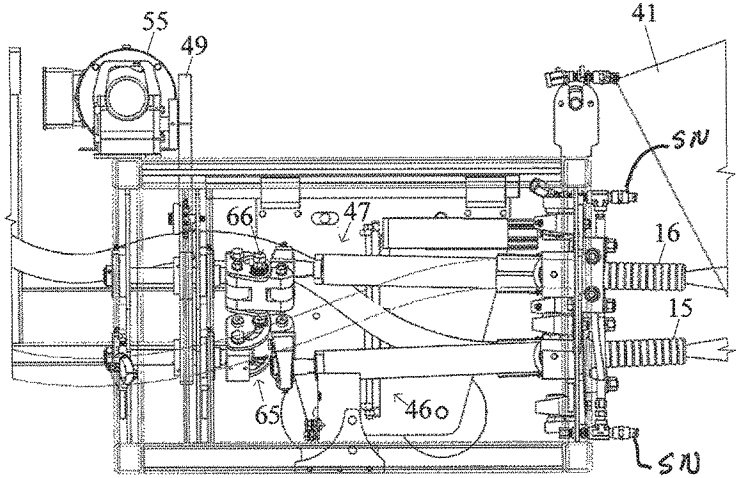
FIG. 5E is a schematic side view of the spray nozzle actuator assembly 55 of the aqueous-based particulate abrasive dispenser in accord with FIG. 4A.

FIGS. 4A-4F and 5A-5E are schematic illustrations of aspects of an example spray material dispenser assembly 14. FIG. 4A is a schematic orthographic view of the spray material dispenser assembly 14. FIG. 4B is a schematic close-up orthographic view of the spray nozzle 16 of the aqueous-based particulate abrasive dispenser 14. FIG. 4C is a schematic side view of the aqueous-based particulate abrasive dispenser 14. FIG. 4D is a schematic top view of the aqueous-based particulate abrasive dispenser 14. FIG. 4E is a schematic close-up top view of the extension assembly 45 of the aqueous-based particulate abrasive dispenser 14. FIG. 4F is a schematic front view of the aqueous-based particulate abrasive dispenser 14. FIG. 5A is a schematic top view of the spray nozzle actuator assembly 55 of the aqueous-based particulate abrasive dispenser 14. FIG. 5B is a schematic orthographic front view of the spray nozzle actuator assembly 55 of the aqueous-based particulate abrasive dispenser 14. FIG. 5C is a schematic orthography back view of the spray nozzle actuator assembly 55 of the aqueous-based particulate abrasive dispenser 14. FIG. 5D is a schematic back view of the spray nozzle actuator assembly 55 of the aqueous-based particulate abrasive dispenser 14. FIG. 5E is a schematic side view of the spray nozzle actuator assembly 55 of the aqueous-based particulate abrasive dispenser 14.

Although alternatives are possible, the spray nozzle 15 is connected to an actuator shaft assembly 46 and the spray nozzle 16 is connected to an actuator shaft assembly 47. The actuator shaft assembly 46 and the actuator shaft assembly 47 are connected to a spray nozzle actuator assembly 55 via a belt drive assembly 49. The belt drive assembly 49 is coupled to the actuator shaft assembly 46 and the actuator shaft assembly 47 via a gear shaft 50. The spray nozzle actuator assembly 55 can comprise a rotary motor arrangement including one or more rotary motors. The spray nozzle actuator assembly 55 can adjust a spatial attribute, such as a position or orientation, of the spray nozzle arrangement 21. The spray nozzle actuator assembly 55 is connected to a first end of the gear shaft 50. When activated, the spray nozzle actuator assembly 55 moves the gear shaft 50 in a circular motion, which rotates the belt drive assembly 49 along its path. As the belt drive assembly 49 rotates, the belt drive assembly 49 causes the actuator shaft assembly 46 and the actuator shaft assembly 47 to rotate via gear assembly 51 of actuator shaft assembly 46 and gear assembly 52 of actuator shaft assembly 47.

The actuator shaft assembly 46 includes an adjustable pivot 65 and the actuator shaft assembly 47 includes an adjustable pivot 66. The adjustable pivot 65 and the adjustable pivot 66 adjustably angle the actuator shaft assembly 46 and the actuator shaft assembly 47 to convert the rotational motion of the gear assembly 51 and 52 to eccentric oscillating motion at the spray nozzle 15 and the spray nozzle 16. Because the adjustable pivot 65 and the adjustable pivot 66 are adjustable, the amount of eccentric motion (e.g., the magnitude of the approximate circular motion of the spray nozzles) generated at the spray nozzle 15 and the spray nozzle 16 can be adjusted.

Although alternatives are possible, the spray nozzle 15 and the spray nozzle 16 can be both horizontally offset and vertically offset from one another. For example, the spray nozzle 15 and the spray nozzle 16 can be disposed above and to a side of the spray nozzle 16. In some embodiments, the positions of the spray nozzle 15 and the spray nozzle 16 relative to one another are coordinated with the motion generated by the spray nozzle actuator assembly 55 so that the regions on the target that are sprayed by the spray nozzle 15 and the spray nozzle 16 abut one another.

The aqueous-based particulate abrasive dispenser 14 can also include an extension assembly 45. The extension assembly 45 can selectively adjust how far the spray nozzle arrangement 21 extends out from the aqueous-based particulate abrasive dispenser 14. For example, the extension assembly 45 can comprise a pneumatic arm that positions the spray nozzle 15 and the spray nozzle 16 closer to or further from the target. In some examples, the extension assembly 45 causes the spray nozzle 15 and the spray nozzle 16 to extend further out from a front surface 48 of the aqueous-based particulate abrasive dispenser 14. Alternatively, the extension assembly 45 causes the aqueous-based particulate abrasive dispenser 14 as a whole to move forwards or backwards along a rail assembly 56. Although alternatives are possible, in the example shown, the aqueous-based particulate abrasive dispenser 14 is disposed on the rail assembly 56 with linear motion bearings 57, 58, 59, and 60.

It is noted that throughout this document, some applications of the equipment in order to cause spray but without aberration of concrete necessarily occurring, has been described. Referring to FIG. 5E at SN, additional spray nozzles are shown that can be used to conduct such a rinse and/or to remove materials such as uncured concrete end or wax from the concrete surface. These can be fed with water from a pressure washer system 20, but without abrasive contained therein. FIGS. 6A-6D are schematic illustrations of the vertical guide rail assembly 17. FIG. 6A is a schematic orthographic view of the vertical guide rail assembly 17. FIG. 6B is a schematic back view of the vertical guide rail assembly 17. FIG. 6C is a schematic top view of the vertical guide rail assembly 17. FIG. 6D is a schematic side view of the vertical guide rail assembly 17.

In addition to the components of the vertical guide rail assembly 17 that have been previously described, the vertical guide rail assembly 17 includes a bearing assembly 61, pulley assembly 62, bearing assembly 63, and bearing assembly 64. The bearing assembly 61, the bearing assembly 63, and the bearing assembly 64 allow for linear movement. Although alternatives are possible, the bearing assembly 61, bearing assembly 63, and bearing assembly 64 each include one or more linear motion bearings. The bearing assembly 63 connects the vertical guide rail assembly 17 to the upper guide rail assembly 30 of the horizontal guide rail assembly 18 and allows the vertical guide rail assembly 17 to move along the upper guide rail assembly 30. Similarly, the bearing assembly 64 connects the fp17 to the lower guide rail assembly 31 of the horizontal guide rail assembly 18 and allows the fp17 to move along the fp31.

As shown in these figures, the enclosure 38 is coupled to the rail assembly 36 and rail assembly 37 via the bearing assembly 61. Although alternatives are possible, the enclosure 38 is shown as connected to a pulley assembly 62 that can move the enclosure 38 up and down vertically along the rail assembly 36 and rail assembly 37. For example, the pulley assembly 62 may be actuated by the vertical position adjustment system 35 (not shown in FIGS. 6A-6D).

Figure 7:
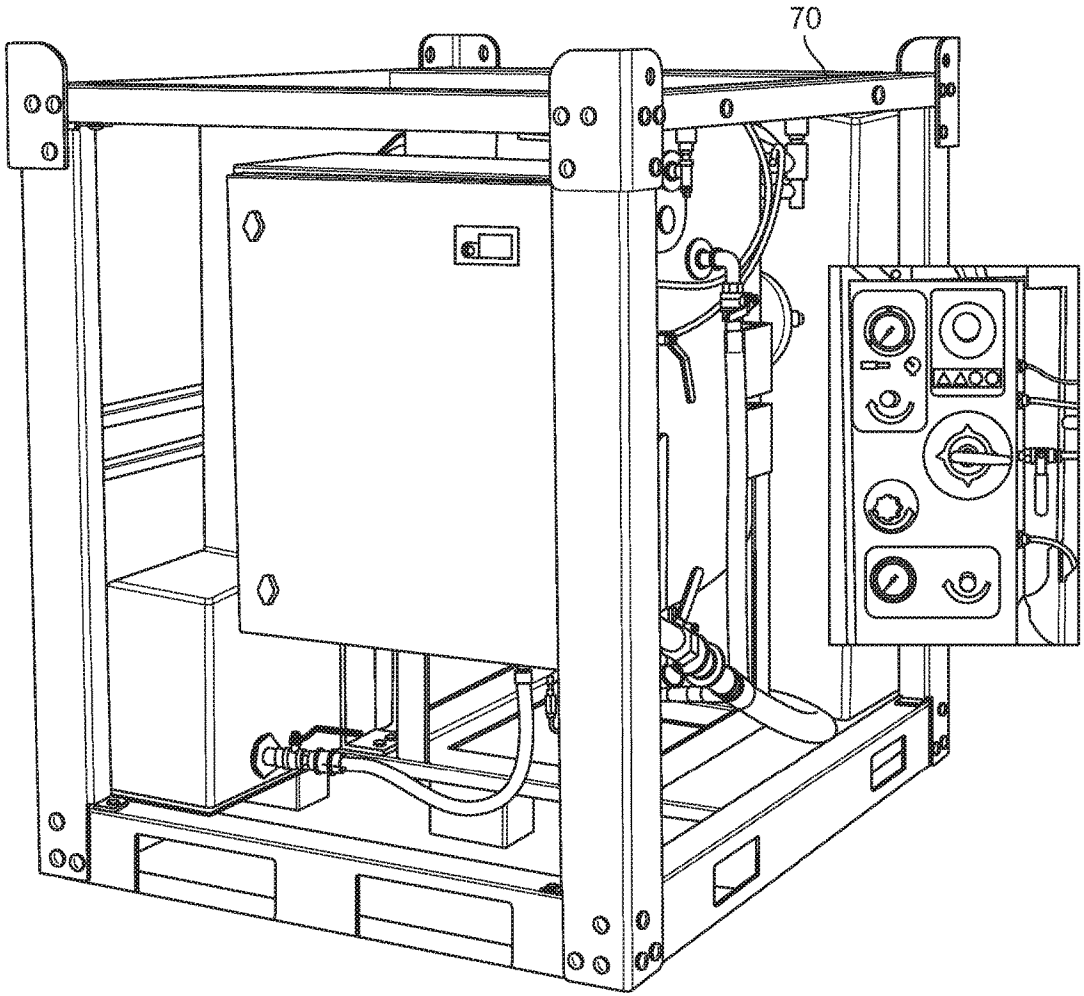
FIG. 7 is a schematic illustration of an example spray material dispensing equipment usable in accord with certain systems and techniques according to the present disclosure.

FIG. 7 is a schematic illustration of example spray material dispensing equipment 70. The spray material dispensing equipment 70 is an example of the dispensing equipment arrangements 6, 7, 8 shown in FIG. 1. Various embodiments of the system 1 may include more or fewer than three of the spray material dispensing equipment. As shown, the spray material dispensing equipment 70 is adapted from ECO-QUIP EQ600s vapor abrasive blast equipment from Graco, Inc. of Minneapolis, Minn. 55413. The spray material dispensing equipment 70 can be adapted from other equipment, however.

II. Example Control Equipment, FIGS. 8-15

Figure 8:
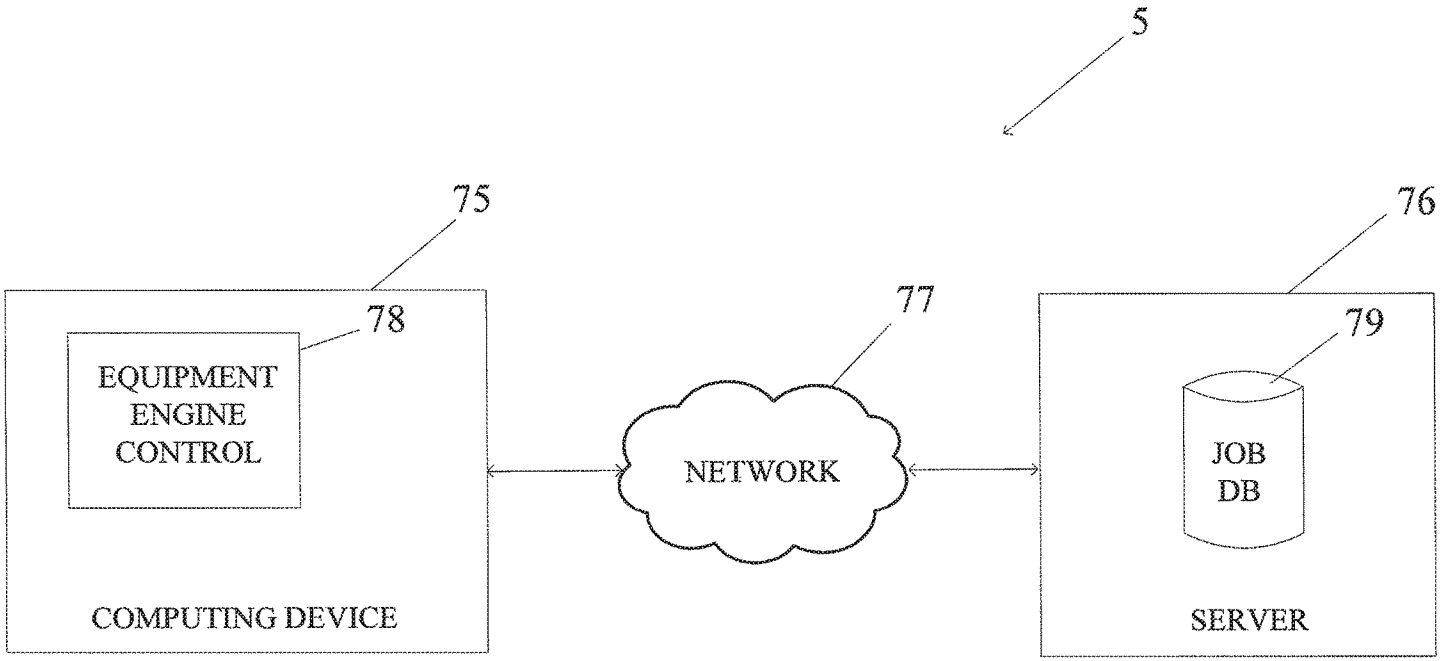
FIG. 8 is a schematic illustration of an example control equipment usable in accord with certain systems and techniques according to the present disclosure.

FIG. 8 is a schematic illustration of the control equipment 5. The control equipment 5 controls the operation of at least some of the components of the sprayer system 1. The control system can send control signals to the components using any communication technology including wired and wireless technologies. In this example, the control equipment 5 includes a local computing device 75 and a server 76 that communicate over a network 77.

The local computing device 75 may be a personal computer or any other type of computing device. In some aspects, the local computing device 75 includes a touch screen and a reader. The local computing device 75 includes an equipment control engine 78 that controls the operation of the material communication assembly 3 and the dispenser positioning arrangement 4.

The equipment control engine 78 may access job specific parameters about a target from a job database 79 on a server using a job identifier. In some embodiments, the equipment control engine 78 receives the job identifier from the reader. The reader reads a job identifier from an identifying element associated with a target (e.g., architectural precast concrete wall panel). The identifying element may be, for example, a barcode or an RFID tag.

Otherwise, an operator may enter the job identifier via a user interface generated by the equipment control engine 78 using a user input device on the local computing device 75. For example, the user may select the job identifier by touching a region of the touch screen (e.g., such as an entry in a list of jobs). Alternatively, the operator may type in the job identifier using a physical or virtual keyboard.

Example User Interfaces of the Control Equipment

FIGS. 9-14 illustrate example user interfaces generated by embodiments of the equipment control engine 78, which may be displayed on a display device of the local computing device 75.

Figure 9:
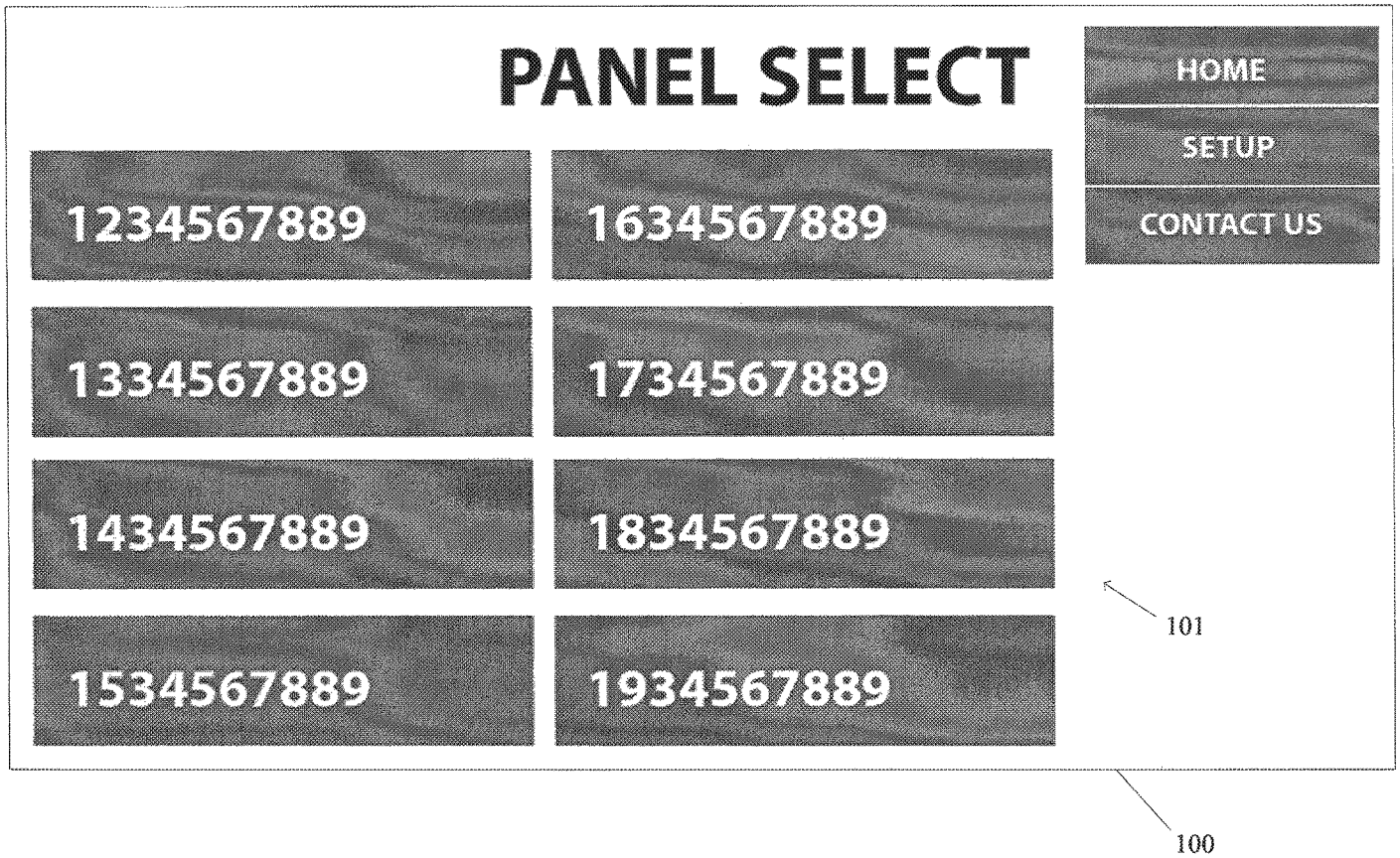
FIG. 9 is a schematic illustration of a job identifier selection screen generated by examples of the control equipment.

FIG. 9 is a schematic illustration of a job identifier selection screen 100. The job identifier selection screen 100 includes a list 101 that includes a plurality of job identifiers. An operator can select a particular job identifier to load the associated job parameters. The job identifiers that are displayed may be retrieved from the job database 79. In some embodiments, the displayed job identifiers are retrieved based on a job date that is stored in the job database 79 and associated with the retrieved job identifiers. For example, all job identifiers that are associated with a particular job date may be displayed in the list 101. In some embodiments, completed jobs are not shown on the panel either (e.g., the job database 79 may store a status field associated with each job identifier).

Figure 10:
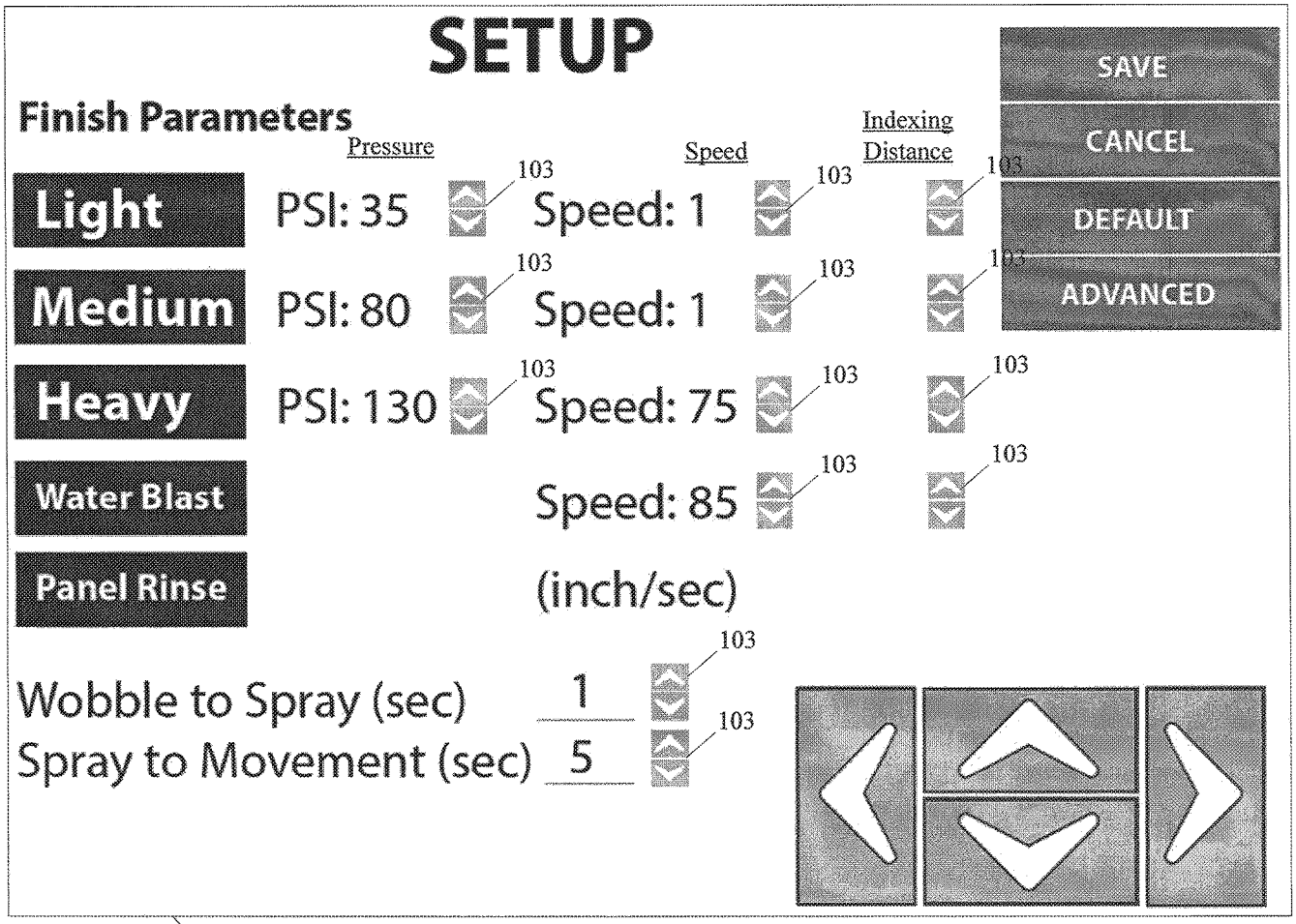
FIG. 10 is a schematic illustration of a setup screen generated by examples of the control equipment.

FIG. 10 is a schematic illustration of a setup screen 102 that displays parameters for a job. The parameters may be loaded from the job database 79 based on the job identifier. In some embodiments, an operator may then adjust the parameters by actuating (e.g., touching, clicking with a mouse) user-actuatable interface elements 103.

Figure 11:
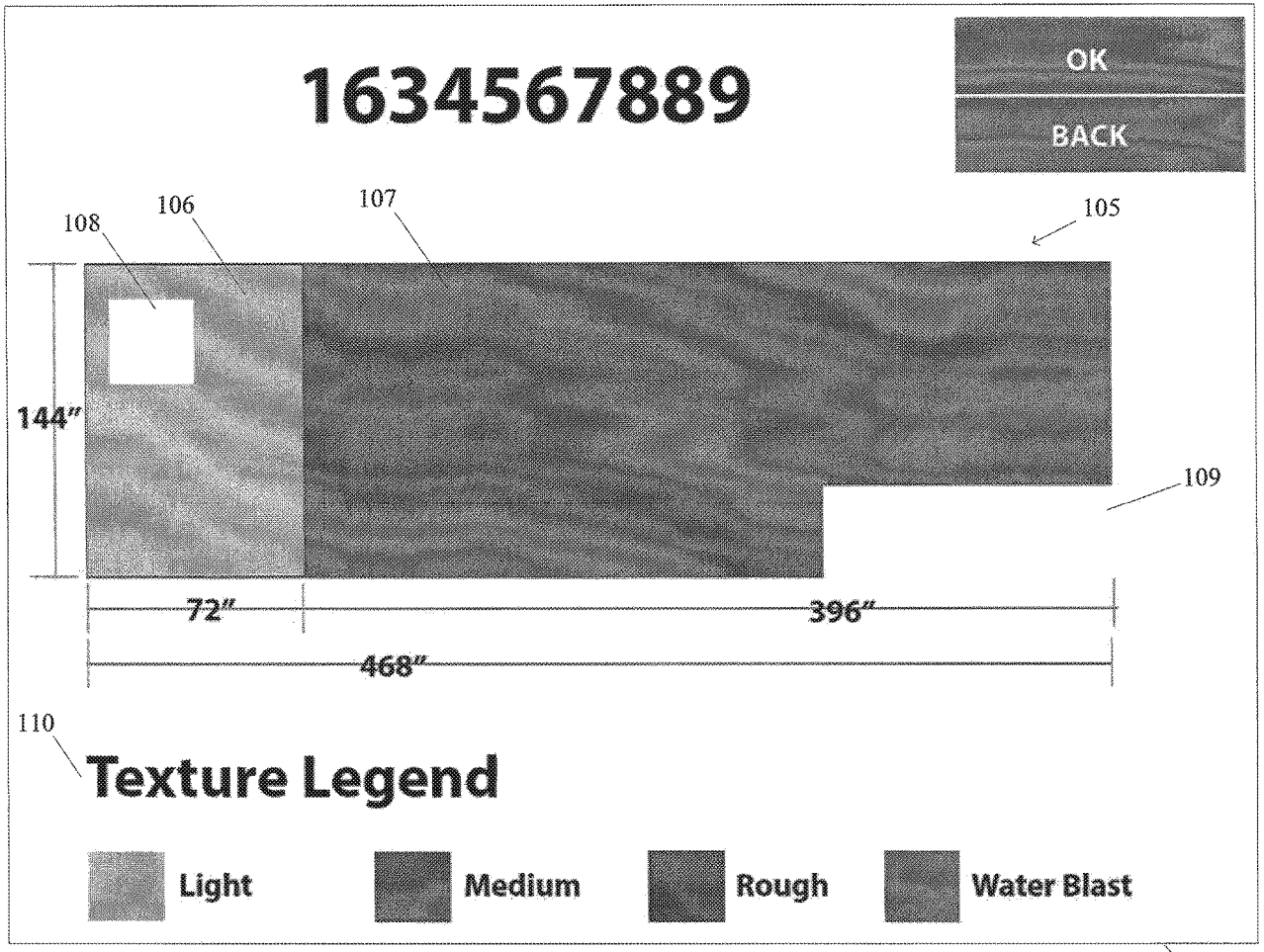
FIG. 11 is a schematic illustration of a job display screen generated by examples of the control equipment.

FIG. 11 is a schematic illustration of a job display screen 104 that displays an illustration of a particular job and target. The job may divide the target into multiple regions, which will be subject to different job parameters. In this example, the target 105 includes a first region 106 and a second region 107. The first region will be subject to job parameters to produce a light texture, while the second region will be subject to job parameters to produce a medium texture. Also shown are cutouts 108 and 109 in the target 105. These cutouts may be for windows and doors. In some embodiments, the cutouts are not subject to any treatment. Various color or shading schemes may be used to identify the job parameters that will be applied. In this example, the job display screen 104 includes a legend 110 to explain the relationship between a displayed color and the job parameters.

During operation, the system 1 may generate the light texture on the first region 106 before generating the medium texture on the second region 107. Prior to the system 1 operating on the first region 106, the operator may place a protective structure/surface over some or all of the second region 107 so that it is protected from the activities occurring with respect to the first region. For similar reasons, after the system 1 is done with the first region 106 and before the system 1 starts on the second region 107, the operator may move the protective structure over to the first region.

Figure 12:
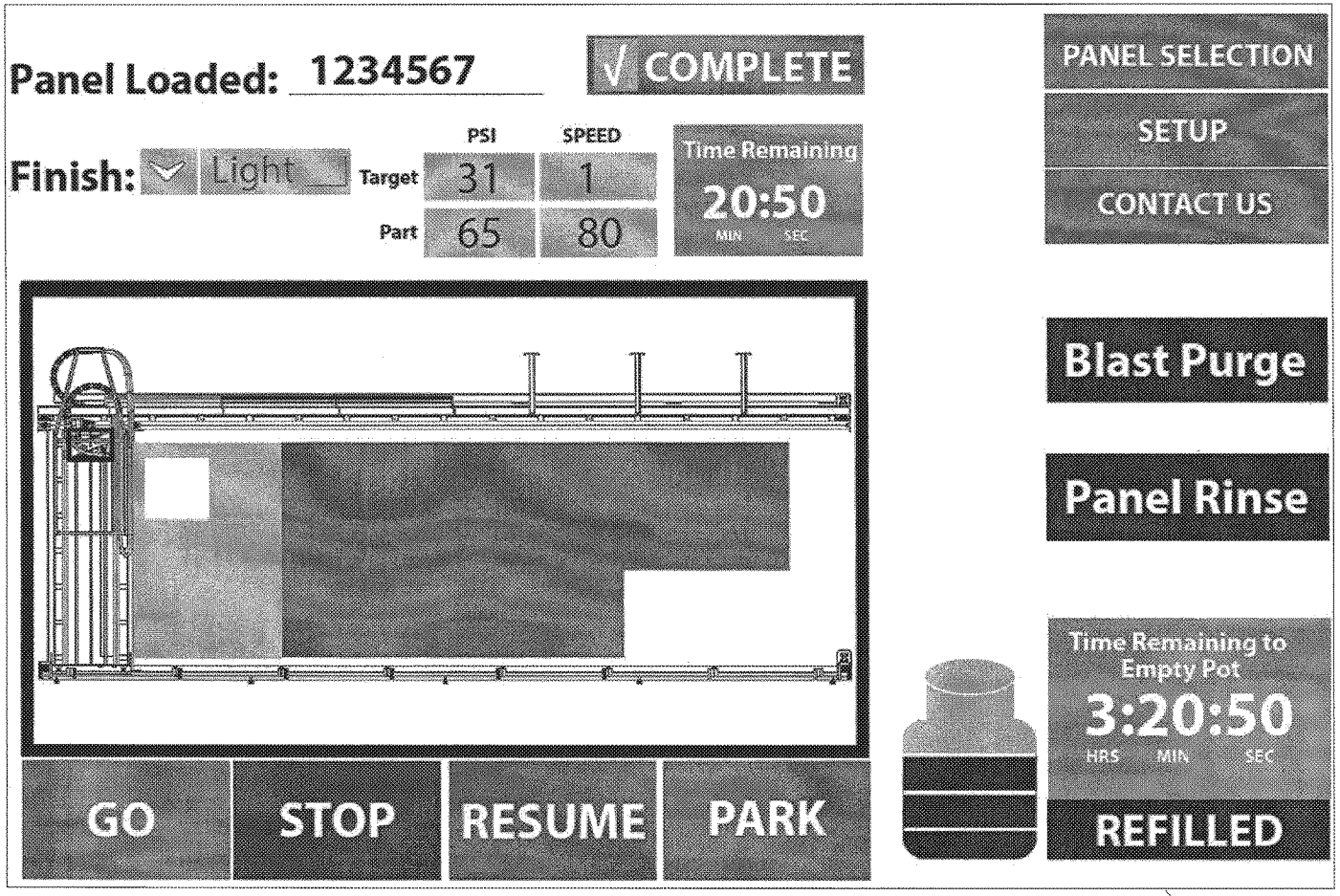
FIG. 12 is a schematic illustration of another job display screen generated by examples of the control equipment.

FIG. 12 is a schematic illustration of a job display screen 111 that shows an in-process job, including the position of the dispensing equipment, the job parameters, and the time remaining in the job. The screen also displays the amount of material remaining in the dispensing equipment. In some embodiments, if the dispensing equipment has an insufficient quantity of material to complete a job, the job is not started.

Figure 13:
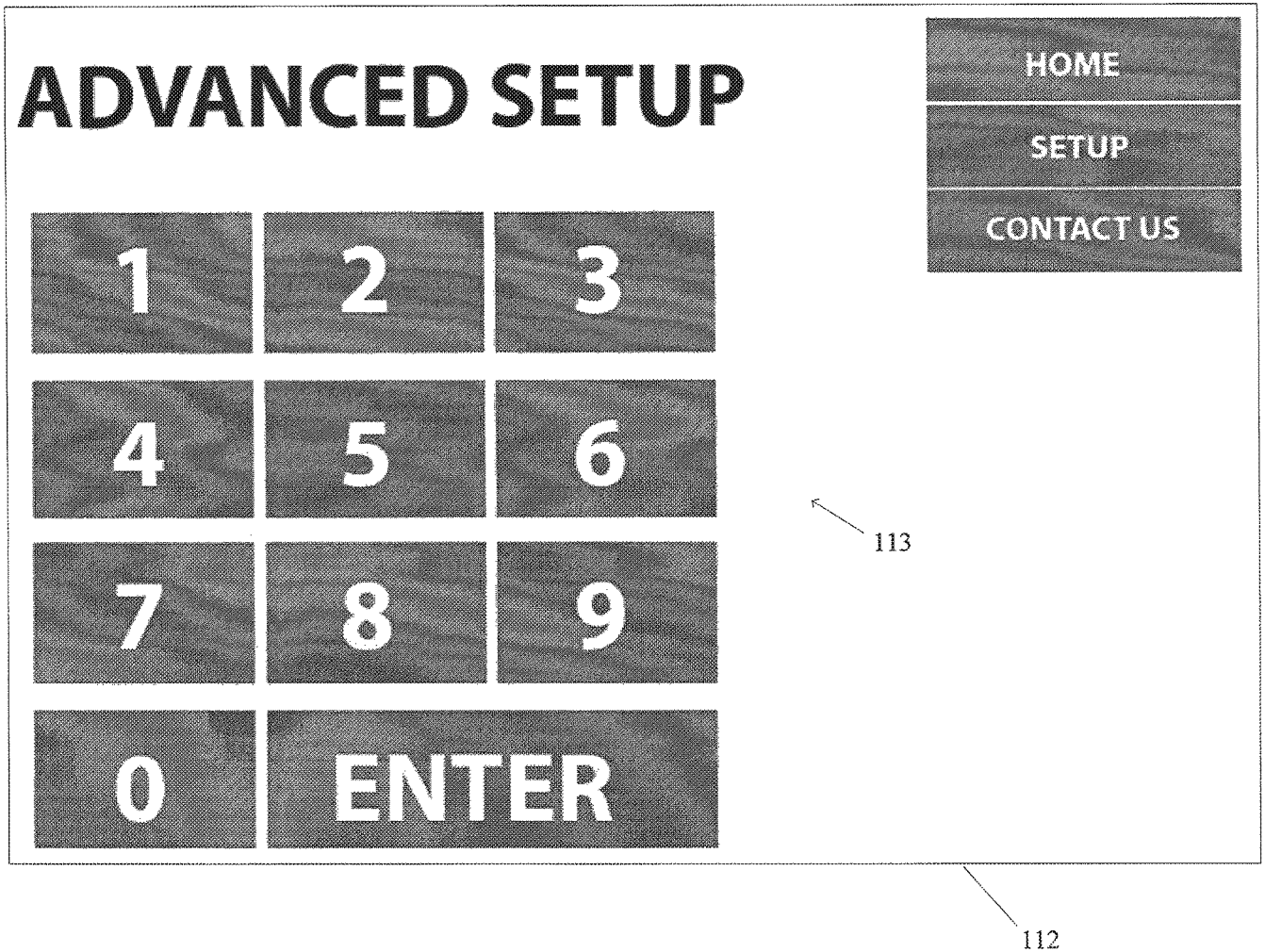
FIG. 13 is a schematic illustration of an advanced setup access screen generated by examples of the control equipment.

FIG. 13 is a schematic illustration of an advanced setup access screen 112. The operator may need to enter a code using a displayed keypad 113 to access the advanced setup screen.

Figure 14:
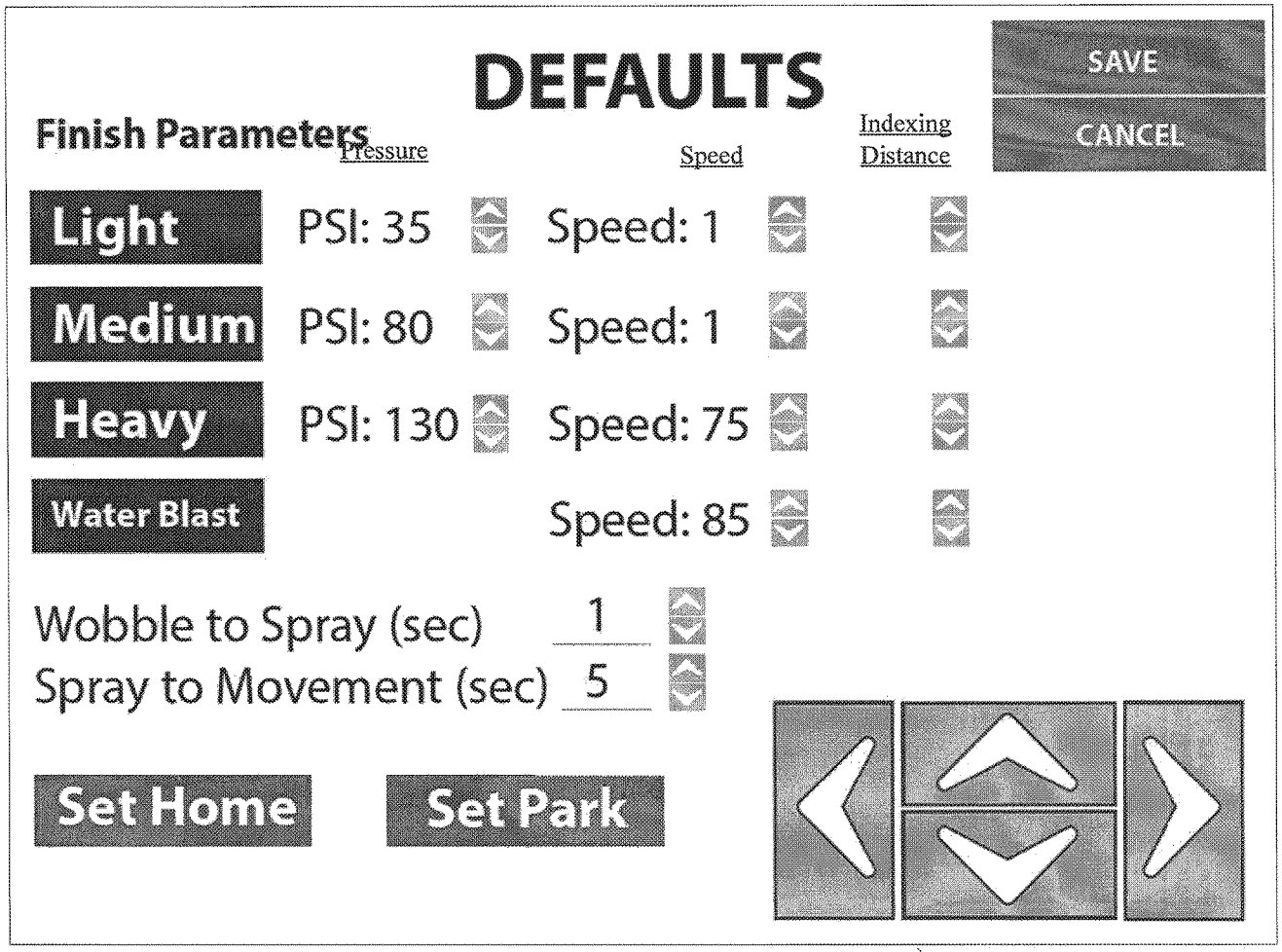
FIG. 14 is a schematic illustration of an advanced settings screen generated by examples of the control equipment.

FIG. 14 is a schematic illustration of an advanced settings screen 114 that allows an operator to adjust default settings for texture levels (e.g., light, medium, and heavy). Although alternatives are possible, in this example, the advanced settings screen 114 can only be accessed by an operator after access has been granted via the advanced setup access screen 112 (shown in FIG. 13).

Example Computing Device of the Control Equipment

Figure 15:
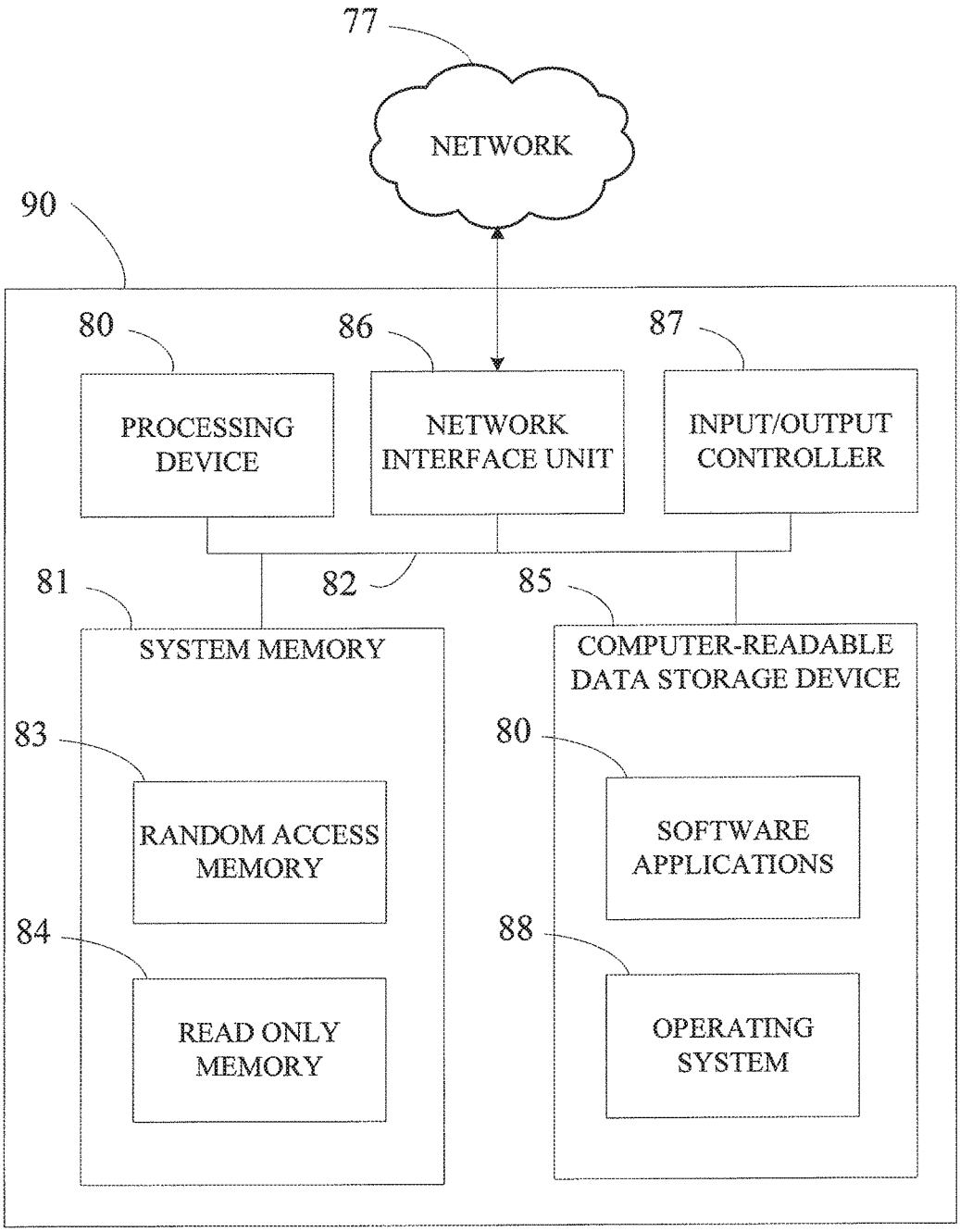
FIG. 15 is a schematic view of a computing device usable with certain control equipment according to the present disclosure.

In FIG. 15, a schematic view of the physical components of an example 90 a computing device, such as the local computing device 75 or the server 76, is shown. As illustrated, the device includes at least one processing device 80, such as a central processing unit ("CPU"), a system memory 81, and a system bus 82 that couples the system memory 81 to the processing device 80. The system memory 81 includes a random access memory ("RAM") 83 and a read-only memory ("ROM") 84. A basic input/output system containing the basic routines that help to transfer information between elements within the device, such as during startup, is stored in the ROM 84. The device further includes a computer-readable data storage device 85. The computer-readable data storage device 85 is able to store software instructions and data.

The computer-readable data storage device 85 is connected to the processing device 80 through a storage controller (not shown) connected to the bus 82. The computer-readable data storage device 85 and its associated computer-readable data storage media provide non-volatile, non-transitory storage for the device. Although the description of computer-readable data storage media contained herein refers to a mass storage device, such as a hard disk or CD-ROM drive, it should be appreciated by those skilled in the art that computer-readable data storage media can be any available non-transitory, physical device or article of manufacture from which the device can read data and/or instructions.

Computer-readable data storage media include volatile and non-volatile, removable and non-removable media implemented in any method or technology for storage of information such as computer-readable software instructions, data structures, program modules or other data. Example types of computer-readable data storage media include, but are not limited to, RAM, ROM, EPROM, EEPROM, flash memory or other solid state memory technology, CD-ROMs, digital versatile discs ("DVDs"), other optical storage media, magnetic cassettes, magnetic tape, magnetic disk storage or other magnetic storage devices, or any other medium which can be used to store the desired information and which can be accessed by the device.

According to various embodiments of the invention, the device may operate in a networked environment using logical connections to remote network devices through the network 77, such as a local network, the Internet, or another type of network. The device connects to the network 77 through a network interface unit 86 connected to the bus 82. The network interface unit 86 may also be used to connect to other types of networks and remote computing systems. The device also includes an input/output controller 87 for receiving and processing input from a number of other devices, including a keyboard, a mouse, a touch user interface display screen, or another type of input device. Similarly, the input/output controller 87 may provide output to a touch user interface display screen, a printer, or other type of output device.

As mentioned above, the computer-readable storage device 85 and the RAM 83 of the device can store software instructions and data. The software instructions include an operating system 88 suitable for controlling the operation of the device. The computer-readable storage device 85 and/or the RAM 83 also store software instructions, that when executed by the processing device 80, cause the device to provide the functionality of the device discussed in this document. For example, the computer-readable storage device 85 and/or the RAM 83 can store software instructions, such as software applications 89 that, when executed by the processing device 80, cause the device to perform as described herein.

III. General Comments and Observation

According to the present disclosure a method of providing a surface portion of an architectural precast concrete wall panel with an abraded texture is provided. The method includes a step of spraying a surface portion of an architectural precast concrete wall panel with an aqueous-based particulate abrasive mixture under conditions adequate to at least partially abrade the surface portion.

Another aspect provided by the present disclosure is a sprayer system for abrading a concrete surface. The system includes an aqueous-based particulate abrasive mixture dispenser including a spray nozzle arrangement. The system also includes a material communication assembly in abrasive flow communication with the aqueous-based particulate abrasive mixture dispenser. The system also includes a dispenser positioning arrangement.

Yet another aspect provided by the present disclosure is an aqueous-based particulate abrasive mixture dispenser apparatus for abrading a concrete surface. The apparatus comprises a vapor abrasive material receiver. The apparatus further comprises a spray nozzle arrangement connected to the vapor abrasive material receiver. The apparatus also comprises a spatial attribute adjustment motor assembly that is connected to the spray nozzle arrangement.

Another aspect provided by the present disclosure is a method of retrofitting an architectural precast concrete wall panel factory to use a sprayer system for preparing a concrete surface. The method includes the step of positioning a framework in a spray chamber of the factory, the framework including a horizontal guide rail assembly and an installation support structure connected to the horizontal guide rail assembly. The method also includes the step of mounting the horizontal guide rail assembly to an overhead support structure. The method also includes the step of removing the installation support structure.

As indicated above, in general, the techniques described herein can be used in situations, in which an aggressive washing of a precast concrete surface is desired. Examples are described in which washer nozzles are included in the equipment that also include nozzles and equipment for abrasive application. Such washers can be used, for example, when the concrete has a wax material thereon at selected locations, or when it has uncured sections of concrete that are to be removed.

What is claimed:

1. A method of providing a surface portion of an architectural precast concrete wall panel with an abraded texture, the method including a step of:

receiving, in a spray chamber of a factory, an uninstalled architectural precast concrete wall panel formed from cement and aggregate and having a thickness of at least three inches;

selecting or defining a predetermined texture to be abraded into a selected surface portion of the architectural precast wall panel with an aqueous-based particulate abrasive mixture by:

defining a motion path for controlling the motion of a dispenser; and defining one or more selected speeds of the dispenser along the motion path; and spraying the selected surface portion of the architectural precast concrete wall panel with the aqueous-based particulate abrasive mixture from the dispenser along the motion path at the one or more selected speeds and pressures to at least partially abrade the selected surface portion to provide the predetermined texture.

2. A method according to claim 1, wherein the step of spraying the surface portion of the architectural precast concrete wall panel comprises sufficiently abrading cement of the architectural precast concrete wall panel to expose aggregate in a selected portion of the surface portion.

3. A method according to claim 2, wherein the step of spraying the surface portion of the architectural precast concrete wall panel comprises abrading the selected portion such that no greater than 25% of the selected portion is sufficiently abraded to expose aggregate embedded in the architectural precast concrete wall panel.

4. A method according to claim 1, wherein the step of spraying the surface portion of the architectural precast concrete wall panel comprises spraying an aqueous-based particulate abrasive mixture having, by volume, at least 50 parts of particulate abrasive to 1 part of liquid.

5. A method according to claim 1, wherein the step of spraying the surface portion of the architectural concrete wall panel comprises spraying an aqueous-based particulate abrasive mixture formed from a liquid having no acid added thereto.

6. A method according to claim 1, wherein the step of spraying the surface portion of the architectural concrete wall panel comprises spraying an aqueous-based particulate abrasive mixture having a pH of at least 6.

7. A method according to claim 1, wherein the step of spraying the surface portion of the architectural precast concrete wall panel comprises spraying an aqueous-based particulate abrasive mixture comprising at least 95% by weight particulate abrasive sized to pass through a mesh of mesh size of at least 4 openings per linear inch.

8. A method according to claim 1, wherein the step of spraying the surface portion of the architectural precast concrete wall panel comprises spraying an aqueous-based particulate abrasive mixture comprising crushed glass.

9. A method according to claim 1, wherein the step of spraying the surface portion of the architectural precast concrete wall panel comprises spraying an aqueous-based particulate abrasive mixture comprising garnet.

10. A method according to claim 1, wherein the step of spraying the surface portion of the architectural precast concrete wall panel comprises spraying an aqueous-based particulate abrasive mixture comprising sand.

11. A method according to claim 10, wherein the step of spraying the surface portion of the architectural precast concrete wall panel comprises spraying an aqueous-based particulate abrasive mixture comprising sand and garnet.

12. A method according to claim 1, further comprising a step of:

moving an aqueous-based particulate abrasive mixture dispenser across the surface portion of the architectural precast concrete wall panel.

13. A method according to claim 12, further comprising a step of:

moving the architectural precast concrete wall panel to a position in front of the aqueous-based particulate abrasive mixture dispenser, wherein the panel has a perimeter area of at least forty square feet.

14. A method according to claim 1, wherein the step of spraying the surface portion of the architectural precast concrete wall panel comprises:

spraying a first region of the surface portion using first dispensing settings; and spraying a second region of the surface portion using second dispensing settings that are different than the first dispensing settings.

15. A method according to claim 1, wherein the step of spraying the surface portion of the architectural precast concrete wall panel comprises spraying the first region using a first horizontal movement speed setting and spraying the second region using a second horizontal movement speed setting that is different from the first horizontal movement speed setting.

16. A method of retrofitting an architectural precast concrete wall panel factory to use a sprayer system for preparing a concrete surface, the method including a step of:

positioning a framework in a spray chamber of the factory, the framework including a horizontal guide rail assembly and an installation support structure connected to the horizontal guide rail assembly;

mounting the horizontal guide rail assembly to an overhead support structure; and removing the installation support structure.

17. The method of claim 1, further including the step of:

defining one or more selected pressures for dispensing an aqueous-based particular abrasive mixture from the dispenser.

* * * * *